US011208991B2

(12) United States Patent
Noh et al.

(10) Patent No.: US 11,208,991 B2
(45) Date of Patent: Dec. 28, 2021

(54) RECIPROCATING COMPRESSOR

(71) Applicant: LG Electronics Inc., Seoul (KR)

(72) Inventors: Kiwon Noh, Seoul (KR); Kyunyoung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 39 days.

(21) Appl. No.: 16/456,927

(22) Filed: Jun. 28, 2019

(65) Prior Publication Data

US 2020/0003198 A1 Jan. 2, 2020

(30) Foreign Application Priority Data

Jun. 29, 2018 (KR) ..... 10-2018-0075782

(51) Int. Cl.

| | |
|---|---|
| ***F04B 35/04*** | (2006.01) |
| ***F04B 39/10*** | (2006.01) |
| ***F04B 17/04*** | (2006.01) |
| ***F04B 39/00*** | (2006.01) |

(52) U.S. Cl.

CPC ..... *F04B 35/045* (2013.01); *F04B 17/04* (2013.01); *F04B 39/0061* (2013.01); *F04B 39/102* (2013.01); *F04B 35/04* (2013.01); *F25B 2400/073* (2013.01)

(58) Field of Classification Search

CPC .... F04B 35/04; F04B 35/045; F04B 39/0061; F04B 17/04; F04B 39/102; F25B 2400/073

USPC ..... 417/416, 417

See application file for complete search history.

(56) References Cited

U.S. PATENT DOCUMENTS 6,824,365 B2 * 11/2004 Park ..... F04B 39/0061 181/403
7,748,967 B2 * 7/2010 Park ..... F04B 35/045 417/545
8,057,200 B2 * 11/2011 Kang ..... F04B 39/0055 417/540
9,695,811 B2 * 7/2017 Kang ..... F04B 39/122
9,845,797 B2 * 12/2017 Ki ..... F04B 17/03

(Continued)

FOREIGN PATENT DOCUMENTS

EP 3333422 6/2018
KR 1020010064566 7/2001

(Continued)

OTHER PUBLICATIONS

EP Search Report in European Application No. 19183197, dated Oct. 4, 2019, 9 pages.

*Primary Examiner* — Christopher S Bobish
(74) *Attorney, Agent, or Firm* — Fish & Richardson P.C.

(57) ABSTRACT

Disclosed is a linear compressor. The linear compressor according to the spirit of the present invention includes a cylinder forming a compression space for refrigerant and a discharge unit forming a discharge space for refrigerant into which refrigerant discharged from the compression space flows. The discharge unit includes a discharge cover having an inner space formed therein and a discharge plenum placed in the inner space. In this case, the discharge plenum includes a plenum flange extending radially, a plenum seating part, a plenum body, and a plenum extension part which extend from a radially inner side end of the plenum flange, and a plenum guide surface extending from a radially outer side end of the plenum flange toward the inner space.

20 Claims, 16 Drawing Sheets

(56) References Cited

U.S. PATENT DOCUMENTS

| | | | | |
|---|---|---|---|---|
| 9,909,581 | B2 * | 3/2018 | Lilie | F04B 39/0027 |
| 10,465,671 | B2 * | 11/2019 | Hahn | F04B 39/1013 |
| 2005/0142014 | A1 * | 6/2005 | Jung | F04B 35/045 417/540 |
| 2006/0093498 | A1 | 5/2006 | Kim | |
| 2008/0260561 | A1 * | 10/2008 | Ribas | F04B 39/125 417/569 |
| 2012/0034114 | A1 * | 2/2012 | Lee | F04B 35/045 417/417 |
| 2013/0266458 | A1 * | 10/2013 | Iwata | F04B 39/0055 417/410.1 |
| 2015/0226210 | A1 * | 8/2015 | Barito | F04B 39/0005 417/415 |
| 2016/0056699 | A1 | 2/2016 | Jeong et al. | |

FOREIGN PATENT DOCUMENTS

| | | |
|---|---|---|
| KR | 1020020077953 | 10/2002 |
| KR | 1020170124903 | 11/2017 |

* cited by examiner

RECIPROCATING COMPRESSOR

CROSS-REFERENCE TO RELATED APPLICATIONS

This application claims the benefit of the Korean Patent Application No. 10-2018-0075782 filed on Jun. 29, 2018, which is hereby incorporated by reference as if fully set forth herein.

BACKGROUND

Generally, a compressor is a mechanical device that receives power from a power generating device such as an electric motor or a turbine and compress air, refrigerant or various other working gases to increase pressure. Compressors are widely used in home appliances or industries.

These compressors are roughly classified into a reciprocating compressor, a rotary compressor, and a scroll compressor.

The reciprocating compressor has a compression space which is formed between a piston and a cylinder and in which a working gas is suctioned or discharged, thereby compressing refrigerant by the piston linearly reciprocating inside the cylinder In addition, the rotary compressor has a compression space which is formed between a cylinder and an eccentrically rotating roller and in which a working gas is suctioned or discharged, thereby compressing refrigerant by the roller eccentrically rotating along an inner wall of the cylinder.

Also, the scroll compressor has a compression space which is formed between an orbiting scroll and a fixed scroll and in which a working gas is suctioned or discharged, thereby compressing refrigerant by the orbiting scroll rotating the fixed scroll.

In recent years, a linear compressor having a piston directly connected to a driving motor that reciprocates linearly, unlike the reciprocating compressor, to have a simple structure and improve compression efficiency without mechanical loss due to motion switching has been developed.

The linear compressor is configured to suction, compress, and then discharge refrigerant while the piston reciprocates linearly in the cylinder by the linear motor inside a sealed shell.

At this time, the linear motor is configured such that a permanent magnet is placed between an inner stator and an outer stator, and the permanent magnet is driven to reciprocate linearly by mutual electromagnetic force between the permanent magnet and the inner (or outer) stator. However, since the permanent magnet is driven while connected to the piston, the linear motor suctions, compresses, and then discharge refrigerant by the piston reciprocating linearly inside the cylinder.

With regard to a linear compressor having such a structure, the present applicant has filed prior art document 1.

PRIOR ART DOCUMENT 1

1. Publication Number: 10-2017-0124903 (Publication Date: Nov. 13, 2017)

2. Title of the Invention: Linear Compressor

Prior art document 1 discloses a linear compressor including a frame coupled to a cylinder, a gas hole formed in the frame, and a gas pocket configured to communicate with the gas hole and deliver a refrigerant gas into the cylinder. The refrigerant gas may function as a gas bearing between the cylinder and the piston to reduce frictional force.

In this case, the linear compressor as in prior art document 1 has the following problems.

(1) A refrigerant gas supplied through the gas hole corresponds to high-temperature refrigerant compressed in the compression space. As the high-temperature refrigerant flow into the piston and the cylinder, heat is transferred to the piston and the cylinder. Then, suction refrigerant flowing into the piston is overheated. Accordingly, there is a problem in which the volume of the suction refrigerant is increased and the compression efficiency is lowered.

(2) In particular, a refrigerant gas supplied through the gas hole corresponds to refrigerant directly discharged from the compression space. Accordingly, the refrigerant gas is very hot, and a relatively large amount of heat is transferred to the piston and the cylinder.

(3) Also, a discharge cover is overheated since refrigerant discharged from the compression space flow into the discharge cover. Also, the heat of the discharge cover is conducted to the frame, and then the heat is transferred from the frame to the piston and the cylinder. In particular, since the frame, the piston, and the cylinder are placed in proximity to one another, the heat of the frame is easily transferred to the piston and the cylinder through conduction. Also, there is an increase in weight of a driving part due to a supporter and a magnet frame, and the driving part cannot be operated at higher operating frequencies.

SUMMARY

The present invention is proposed to solve the above problems and is directed to providing a linear compressor having a discharge plenum brought into close contact with a discharge cover in order to prevent an increase in temperature of the discharge cover due to refrigerant discharged from a compression space.

Also, the present invention is also directed to providing a linear compressor having a structure for decreasing the temperature of the bearing refrigerant supplied to a gap between the cylinder and the piston.

In particular, the present invention is directed to a linear compressor in which refrigerant discharged from the compression space is supplied through a plurality of flow paths as the bearing refrigerant.

The linear compressor according to the spirit of the present invention includes a cylinder forming a compression space for refrigerant and a discharge unit forming a discharge space for refrigerant into which refrigerant discharged from the compression space flows. The discharge unit includes a discharge cover having an inner space formed therein and a discharge plenum placed in the inner space. In this case, the discharge plenum includes a plenum flange extending radially, a plenum seating part, a plenum body, and a plenum extension part which extend from a radially inner side end of the plenum flange, and a plenum guide surface extending from a radially outer side end of the plenum flange toward the inner space.

Also, the plenum flange may extend radially such that the outer side end is brought into contact with the inner space, and the plenum guide surface may extend axially upward from the outer side end of the plenum flange.

The plenum flange may be divided into an upper space located at an axially upper side of the plenum flange and a lower space located at an axially lower side of the plenum flange. In this case, the plenum seating part, the plenum body, and the plenum extension part, and the plenum guide surface are placed in the upper space.

Also, a bearing guide groove through which refrigerant flows from the upper space to the lower space may be formed on at least any one of the plenum guide surface or an inner side surface of the discharge cover.

The linear compressor configured as described above and according to the embodiment of the present invention has the following effects.

By decreasing the temperature of bearing refrigerant supplied to a cylinder and a piston, it is possible to prevent an increase in temperature of the cylinder and the piston. Also, it is possible to prevent a reduction in compression efficiency due to overheating of suction gas accommodated in the piston.

In addition, since the discharge plenum is placed in close contact with the discharge cover, it is possible to prevent an increase in temperature of the discharge cover because of refrigerant discharged from the compression space. Accordingly, it is possible to reduce heat transferred from the discharge cover to the frame, and also to prevent an increase of temperature of the cylinder and the piston.

Also, it is possible to minimize the surface area of the frame covered by the discharge cover and also to reduce conduction heat transfer from the discharge cover to the frame. Also, since the surface area of the frame exposed to the refrigerant in the inner space of the shell, it is possible to increase convection heat transfer (heat dissipation) to the refrigerant inside the shell.

Also, by removing at least a portion of the discharge cover in order to minimize an area that is in contact with the frame, it is possible to reduce material cost of the discharge cover.

The details of one or more embodiments are set forth in the accompanying drawings and the description below. Other features will be apparent from the description and drawings, and from the claims.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION OF THE DISCLOSURE

Reference will now be made in detail to the exemplary embodiments of the present invention, examples of which are illustrated in the accompanying drawings. Wherever possible, the same reference numbers will be used throughout the drawings to refer to the same or like parts.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
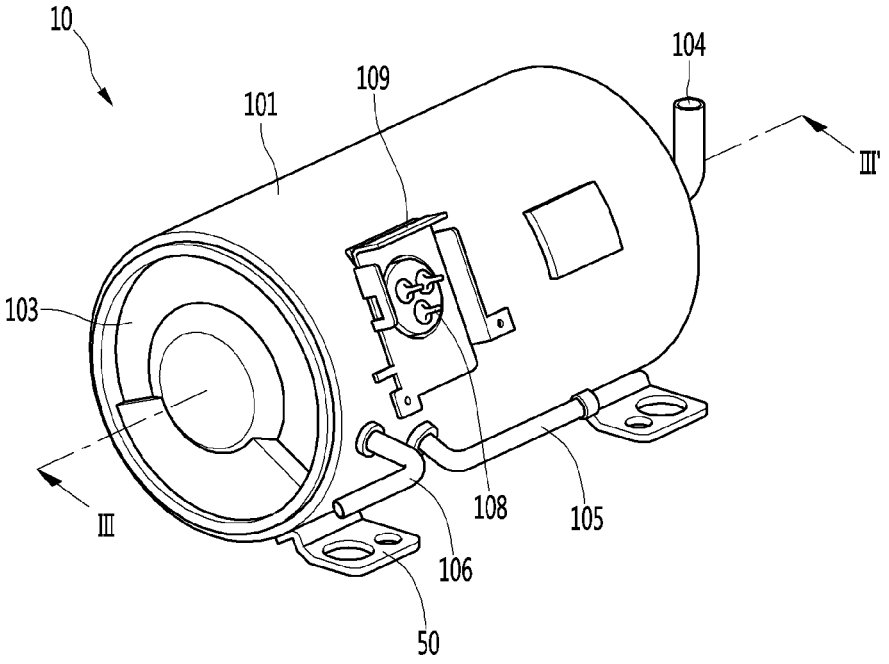
FIG. 1 is a view showing a linear compressor according to an embodiment of the present invention.

FIG. 1 shows a linear compressor according to an embodiment of the present invention.

As shown in FIG. 1, a linear compressor 10 according to an embodiment of the present invention a shell 101 and shell covers 102 and 103 coupled to the shell 101. In a broad sense, the shell covers 102 and 103 may be understood as elements of the shell 101.

A leg 50 may be coupled to a lower side of the shell 101. The leg may be coupled to a base of a product where the linear compressor 10 is installed. For example, the product may include a refrigerator, and the base may include a base of a mechanical chamber of the refrigerator. As another example, the product may include an outdoor device of an air conditioner, and the base may include a base of the outdoor device.

The shell may have an approximately cylindrical shape, which is transversely or axially laid down. Referring to FIG. 1, the shell 101 may be long transversely and somewhat short radially. That is, the linear compressor 10 may have a small height. Accordingly, for example, when the linear compressor 10 is installed in a base of a mechanical chamber of a refrigerator, it is possible to decrease the height of the mechanical chamber.

Also, the longitudinal center axis of the shell 101 matches the center axis of a compressor body, which will be described below, and the center axis of the compressor body matches the center axis of the cylinder and the piston.

A terminal 108 may be installed on an outer surface of the shell 101. The terminal 108 is understood as an element for delivering external power to a motor assembly 140 (see FIG. 3) of the linear compressor. In particular, the terminal 108 may be connected to a lead wire of a coil 141*c* (see FIG. 3).

A bracket 109 is installed outside the terminal 108. The bracket 109 may include a plurality of brackets surrounding the terminal 108. The bracket 109 may be configured to protect the terminal 108 from an external shock or the like.

The shell 101 has both open sides. The shell covers 102 and 103 may be coupled to both the open sides of the shell 101. In detail, the shell covers 102 and 103 include a first shell cover 102 (see FIG. 3) coupled to one open side of the shell 101 and a second shell cover 103 coupled to the other open side of the shell 101. The shell 101 may have an inner space sealed by the shell covers 102 and 103.

Referring to FIG. 1, the first shell cover 102 may be placed to the right of the linear compressor 10, and the second shell cover 103 may be placed to the left of the linear compressor 10. In other words, the first and second shell covers 102 and 103 may be placed to face each other. Also, the first shell cover 102 may be understood as being located at a side for suctioning refrigerant, and the second shell cover 103 may be understood as being located at a side for discharging refrigerant.

The linear compressor 10 further includes a plurality of pipes 104, 105, and 106 provided in the shell 101 or the shell covers 102 and 103 and configured to suction, discharge, or inject refrigerant.

The plurality of pipes 104, 105, and 106 include a suction pipe 104 for enabling refrigerant to be suctioned into the linear compressor 10, a discharge pipe 105 for enabling compressed refrigerant to be discharged from the linear compressor 10, and a process pipe 106 for refill refrigerant in the linear compressor 10.

For example, the suction pipe 104 may be coupled to the first shell cover 102. Refrigerant may be axially suctioned into the linear compressor 10 through the suction pipe 104.

The discharge pipe 105 may be coupled to the outer circumferential surface of the shell 101. The refrigerant suctioned through the suction pipe 104 may be compressed while flowing axially. Then, the compressed refrigerant may be discharged through the discharge pipe 105. The discharge pipe 105 may be placed closer to the second shell cover 103 than to the first shell cover 102.

The process pipe 106 may be coupled to the outer circumferential surface of the shell 101. A worker may inject refrigerant into the linear compressor 10 through the process pipe 106.

The process pipe 106 may be coupled to the shell 101 at a height different from that of the discharge pipe 105 in order to avoid interference with the discharge pipe 105. The height is understood as a vertical distance from the leg 50. Since the discharge pipe 105 and the process pipe 106 are coupled to the outer circumferential surface of the shell 101 at different heights, it is possible to improve operational convenience.

At least a portion of the second shell cover 103 may be placed adjacent to the inner circumferential surface of the shell 101 corresponding to a point where the process pipe 106 is coupled. In other words, at least a portion of the second shell cover 103 may act as resistance against the refrigerant injected through the process pipe 106.

Accordingly, with regards to a flow path for the refrigerant, a flow path of the refrigerant injected through the process pipe 106 is narrowed by the second shell cover 103 when entering the inner space of the shell 101 and is widened when passing out of the inner space. In this process, the refrigerant is vaporized due to a decrease in pressure. Thus, oil contained in the refrigerant may be separated. Accordingly, the refrigerant from which oil is separated is injected into the piston 130 (see FIG. 3), and thus it is possible to improve refrigerant compressibility. The oil may be understood as hydraulic oil present in a cooling system.

A device for supporting a compressor body placed inside the shell 101 may be provided inside the first and second shell covers 102 and 103. The compressor body may refer to a component provided inside the shell 101. For example, a driving part for reciprocating forward and backward and a support part for supporting the driving part may be included in the compressor body.

The compressor body will be described below in detail.

Figure 2:
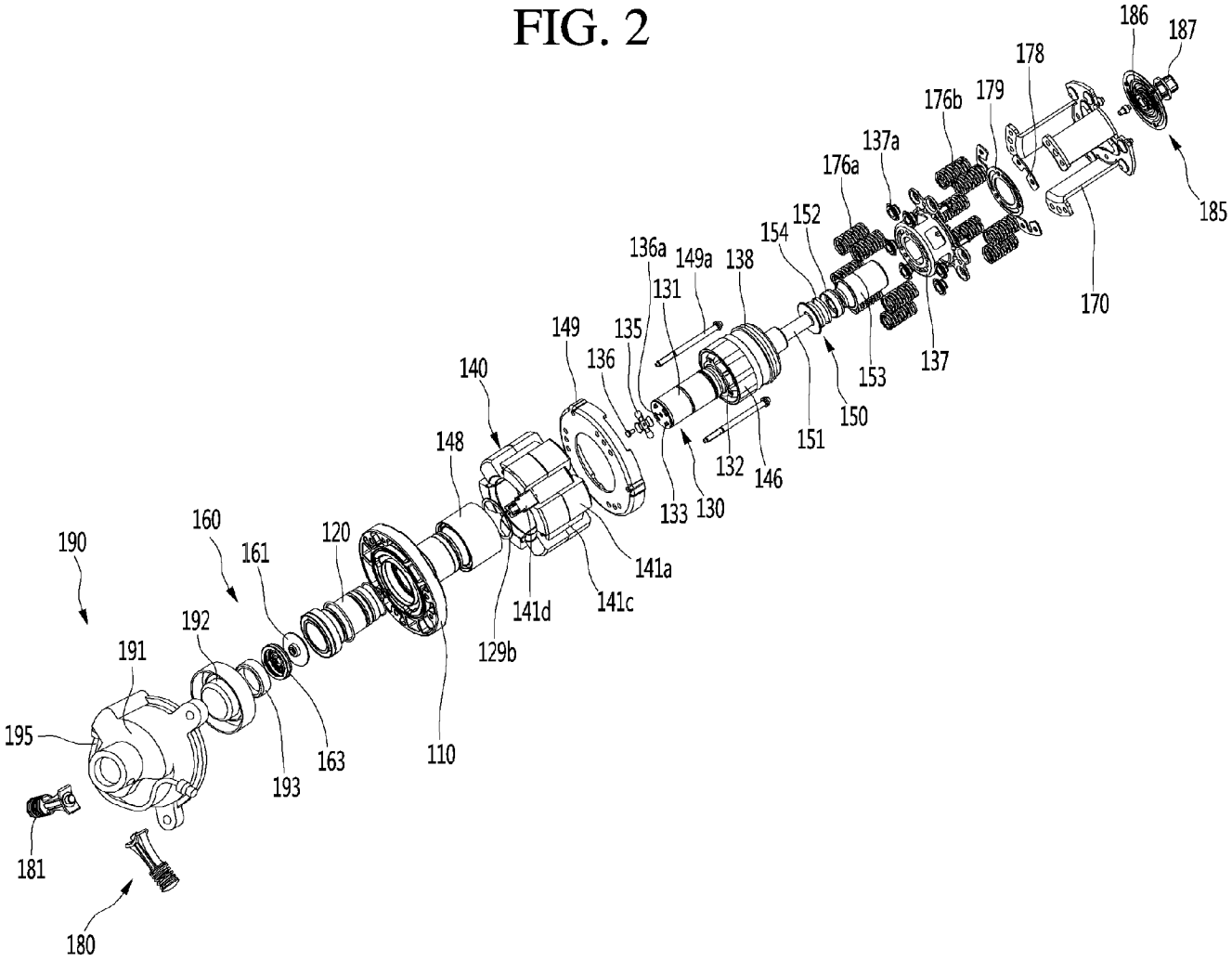
FIG. 2 is an exploded perspective view showing an internal configuration of a linear compressor according to an embodiment of the present invention.
Figure 3:
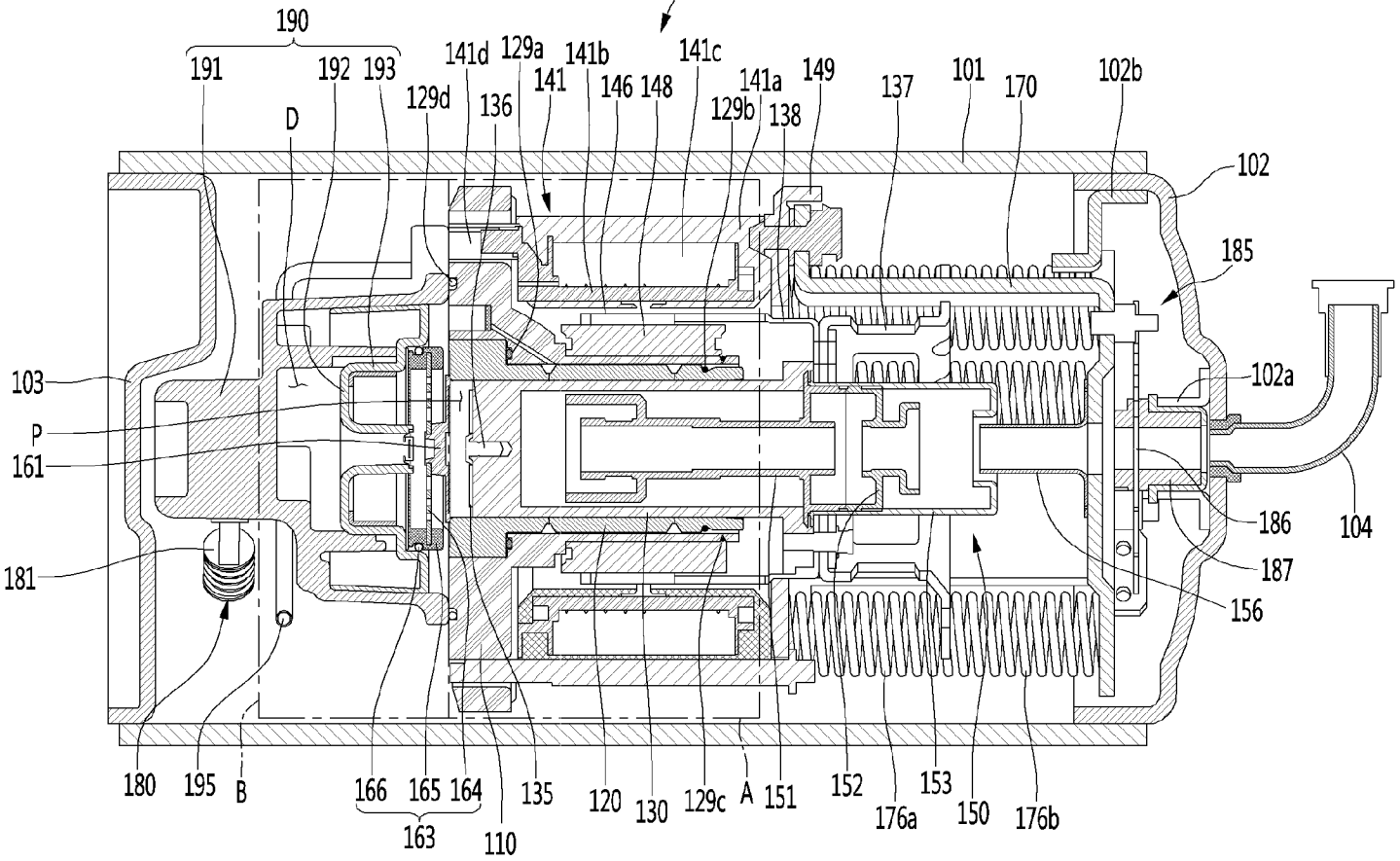
FIG. 3 is a sectional view taken along line of FIG. 1.

FIG. 2 is an exploded perspective view showing an internal configuration of a linear compressor according to an embodiment of the present invention, and FIG. 3 is a sectional view taken along line III-III' of FIG. 1.

Referring to FIGS. 2 and 3, the linear compressor 10 according to an embodiment of the present invention includes a frame 110, a cylinder 120, a piston 130 reciprocating linearly inside the cylinder 120, and a motor assembly 140, which is a linear motor for assigning a driving force to the piston 130. When the motor assembly 140 is driven, the piston 130 may reciprocate axially.

Directions are defined below.

The term "axial direction" may be understood as a direction in which the piston 130 is reciprocating, that is, a traverse direction in FIG. 3. Also, in "axial direction," a direction from the suction pipe 104 toward a compression space P, that is, a direction in which refrigerant flows is referred to as "forward," and the opposite direction is referred to as "backward." When the piston 130 moves forward, the compression space P may be compressed.

The term "radially" may be understood as a direction vertical to the direction in which the piston 130 is reciprocating, that is, a longitudinal direction in FIG. 3. Also, a direction away from the center axis of the piston 130 is referred to as "outward," and a direction toward the center axis is referred to as "inward." As described above, the center axis of the piston 130 may match the center axis of the shell 101.

The frame 110 is understood as an element for fixing the cylinder 120. The frame 110 is placed to surround the cylinder 120. That is, the cylinder 120 may be located inside, and accommodated in, the frame 110. For example, the cylinder 120 may be press-fit into the frame 110. Also, the cylinder 120 and the frame 110 may be made of aluminum or aluminum alloy.

The cylinder 120 may be configured to accommodate at least a portion of the piston 130. Also, a compression space P in which refrigerant is compressed by the piston 130 is formed inside the cylinder 120.

In this case, the compression space P may be understood as a space formed between the suction valve 135 and the discharge valve 161, which will be described below. Also, the suction valve 135 may be formed at one side of the compression space P, and the discharge valve 161 may be provided at the other side of the compression space P, that is, at the opposite side of the suction valve 135.

The piston 130 includes a piston body 131 having an approximately cylindrical shape and a piston flange 132 extending radially from the piston body 131. The piston body 131 may reciprocate inside the cylinder 120, and the piston flange 132 may reciprocate outside the cylinder 120.

A suction hole 133 for injecting refrigerant into the compression space P is formed at a front portion of the piston body 131, and a suction valve 135 for selectively opening the suction hole 133 is provided in front of the suction hole 133.

Also, a fastening hole 136*a* to which a predetermined fastening member 136 is to be coupled is formed at the front portion of the piston body 131. In detail, the fastening hole 136*a* is placed at the center of the front portion of the piston body 131, and a plurality of suction holes 133 are formed to surround the fastening hole 136*a*. Also, the fastening member 136 is coupled to the fastening hole 136*a* through the suction valve 135 to fix the suction valve 135 at the front portion of the piston body 131.

The motor assembly 140 includes an outer stator 141 fixed at the frame 110 and placed to surround the cylinder 120, an inner stator 148 spaced apart from the inside of the outer stator 141, and a permanent magnet 146 placed between the outer stator 141 and the inner stator 148.

The permanent magnet 146 may reciprocate linearly due to mutual electromagnetic force between the outer stator 141 and the inner stator 148. Also, the permanent magnet 146 may be configured as a single magnet having one pole, or configured as a combination of a plurality of magnets having three poles.

The permanent magnet 146 may be installed in the magnet frame 138. The magnet frame 138 may have an approximately cylindrical shape and may be placed to be insertable between the outer stator 141 and the inner stator 148.

In detail, referring to FIG. 3, the magnet frame 138 may be coupled to the piston flange 132 to extend radially outward and may be bent forward. In this case, the permanent magnet 146 may be installed in front of the magnet frame 138. Accordingly, when the permanent magnet 146 reciprocates, the piston 130 may reciprocate axially together with the permanent magnet 146 by means of the magnet frame 138.

The outer stator 141 includes coil winding bodies 141*b*, 141*c*, and 141*d* and a stator core 141*a*. The coil winding bodies include a bobbin 141*b* and a coil 141*c* wound toward the circumference of the bobbin 141*b*.

Also, the coil winding bodies further include a terminal part 141*d* for guiding a power line connected to the coil 141*c* to be drawn or exposed to the outside of the outer stator 141. The terminal part 141*d* may be inserted into a terminal insertion hole 1104 (see FIG. 4) provided in the frame 110.

The stator core 141*a* includes a plurality of core blocks formed by circumferentially stacking a plurality of laminations. The plurality of core blocks may be placed to surround at least a portion of the coil winding bodies 141*b* and 141*c*.

A stator cover 149 is provided at one side of the outer stator 141. That is, one side of the outer stator 141 may be supported by the frame 110, and the other side may be supported by the stator cover 149.

Also, the linear compressor 10 further includes a cover fastening member 149*a* for fastening the stator cover 149 and the frame 110. The cover fastening member 149*a* may extend forward toward the frame 110 through the stator cover 149 and may be coupled to a stator fastening hole 1102 (see FIG. 4) of the frame 110.

The inner stator 148 is fixed at the outer periphery of the frame 110. Also, the inner stator 148 is configured by circumferentially stacking a plurality of laminations outside the frame 110.

Also, the linear compressor 10 further includes a suction muffler 150 coupled to the piston 130 to reduce noise generated from refrigerant suctioned through the suction pipe 104. The refrigerant suctioned through the suction pipe 104 flows into the piston through the suction muffler 150. For example, while the refrigerant passes through the suction muffler 150, it is possible to reduce the flow noise of the refrigerant.

The suction muffler 150 includes a plurality of mufflers 151, 152, and 153. The plurality of mufflers includes a first muffler 151, a second muffler 152, and a third muffler 153, which are coupled to one another.

The first muffler 151 is placed inside the piston 130, and the second muffler 152 is coupled to the rear side of the first muffler 151. Also, the third muffler 153 may accommodate the second muffler 152 and extend backward from the first muffler 151. With regards to the flow direction of the refrigerant, the refrigerant suctioned through the suction pipe 104 may sequentially pass through the third muffler 153, the second muffler 152, and the first muffler 151. In this process, it is possible to reduce the flow noise of the refrigerant.

Also, the suction muffler 150 further includes a muffler filter 154. The muffler filter 154 may be placed on an interface to which the first muffler 151 and the second muffler 152 are coupled. For example, the muffler filter 154 may have a circular shape, and the outer periphery of the muffler filter 154 may be supported between the first and second mufflers 151 and 152.

Also, the linear compressor 10 further includes a supporter 137 for supporting the piston 130. The supporter 137 may be coupled to the rear side of the piston 130, and the muffler 150 may be formed to pass through the supporter 137. Also, the piston flange 132, the magnet frame 138, and the supporter 137 may be fastened by a fastening member.

A balance weight 179 may coupled to the supporter 137. The weight of the balance weight 179 may be determined on the basis of the operating frequency range of the compressor body. Also, a spring support part 137*a* to be coupled to a first resonance spring 176*a*, which will be described below, may be coupled to the supporter 137.

Also, the linear compressor 10 further includes a rear cover coupled to the stator cover 149 to extend backward. The rear cover 170 may include three supporting legs, which may be coupled to the rear surface of the stator cover 149.

A spacer 178 may be placed between the three supporting legs and the rear surface of the stator cover 149. By adjusting the thickness of the spacer 178, it is possible to determine a distance from the stator cover 149 to a rear end of the rear cover 170. Also, the rear cover 170 may be spring-supported by the supporter 137.

Also, the linear compressor 10 further includes an inflow guide part 156 coupled to the rear cover 170 to guide refrigerant to flow into the muffler 150. At least a portion of the inflow guide part 156 may be inserted into the suction muffler 150.

Also, the linear compressor 10 further includes a plurality of resonance springs 176*a* and 176*b* having natural frequencies adjusted so that the piston 130 can resonate. The plurality of resonance springs 176*a* and 176*b* include a first resonance spring 176*a* supported between the supporter 137 and the stator cover 149 and a second resonance spring 176*b* supported between the supporter 137 and the rear cover 170.

By the actions of the plurality of resonance springs 176*a* and 176*b*, the driving part reciprocating inside the linear compressor 10 may operate stably, and also it is possible to reduce occurrence of vibration or noise caused by the movement of the driving part.

Also, the linear compressor 10 further includes a discharge unit 190 and a discharge valve assembly 160.

The discharge unit 190 forms a discharge space D for refrigerant discharged from the compression space P. The discharge unit 190 includes a discharge cover 191 coupled to the front surface of the frame 110 and a discharge plenum 192 placed inside the discharge cover 191. Also, the discharge unit 190 may further include a cylinder-shaped fixing ring 193 brought into close contact with the inner circumferential surface of the discharge plenum 192.

The discharge valve assembly 160 is coupled inside the discharge unit 190 to discharge refrigerant compressed in the compression space P to the discharge space D. Also, the discharge valve assembly 160 may include a discharge valve 161 and a spring assembly 163 configured to provide an elastic force to bring the discharge valve 161 into close contact with a front end of the cylinder 120.

The spring assembly 163 includes a plate-spring-shaped valve spring 164, a spring support part 165 placed at an edge of the valve spring 164 to support the valve spring 164, and a friction ring 166 fitted to the outer circumferential surface of the spring support part 165.

A front center portion of the discharge valve 161 is fixedly coupled to the center of the valve spring 164. Also, the rear surface of the discharge valve 161 is brought into close contact with the front surface (or a front end) of the cylinder 120 by an elastic force of the valve spring 164.

When the pressure of the compression space P is greater than or equal to a discharge pressure, the valve spring 164 is elastically deformed toward the discharge plenum 192. Also, since the discharge valve 161 is separated from a front end portion of the cylinder 120, refrigerant may be discharged from the compression space P to the discharge space D (or a discharge chamber) formed inside the discharge plenum 192.

That is, when the discharge valve 161 is supported on the front surface of the cylinder 120, the compression space P is kept sealed. On the other hand, when the discharge valve 161 is separated from the front surface of the cylinder 120, the compression space P is opened, and thus the refrigerant compressed inside the compression space P may be discharged.

Also, the linear compressor 10 may further include a cover pipe 195. The cover pipe 195 discharges the refrigerant flowing into the discharge unit 190 to the outside. In this case, the cover pipe 195 has one end coupled to the discharge cover 191 and the other end coupled to the discharge pipe 105. Also, the cover pipe 195 is at least partially made of a flexible material and may extend roundly along the inner circumferential surface of the shell 101.

Also, the linear compressor 10 includes a plurality of sealing members, each of which increases a coupling force between the frame 110 and any component near the frame 110. The plurality of sealing members may have a ring shape.

In detail, the plurality of sealing members include first and second sealing members 129*a* and 129*b* provided at a position to which the frame 110 and the cylinder 120 are to be coupled. In this case, the first sealing member 129*a* is inserted into, and installed in, the frame 110, and the second sealing member 129*b* is inserted into, and installed in, the cylinder 120.

Also, the plurality of sealing members include a third sealing member 129*c* provided at a position to which the frame 110 and the inner stator 148 are to be coupled. The third sealing member 129*c* may be inserted into, and installed in, the outer surface of the frame 110.

Also, the plurality of sealing members include a fourth sealing member 129*d* provided at a position to which the frame 110 and the discharge cover 191 are to be coupled. The fourth sealing member 129*d* may be inserted into, and installed in, the front surface of the frame 110.

Also, the linear compressor 10 includes supporting devices 180 and 185 for fixing the compressor body to the inside of the shell 101. The supporting devices include a first supporting device 185 placed at a suctioning side of the compressor body and a second supporting device 180 placed at a discharging side of the compressor body.

The first supporting device 185 includes a suction spring 186 provided in the form of a circular plate spring and a suction spring support part 187 inserted into the center of the suction spring 186.

The outer edge of the suction spring 186 may be fixed to the rear surface of the rear cover 170 by a fastening member. The suction spring support part 187 is coupled to a cover support part 102*a* placed at the center of the first shell cover 102. Thus, a rear end of the compressor body may be elastically supported at the center of the first shell cover 102.

Also, a suction stopper 102*b* may be provided at the inner edge of the first shell cover 102. The suction stopper 102*b* is understood as an element for preventing the compressor assembly, in particular, the motor assembly 140 from being damaged by colliding against the shell 101 due to shaking, vibration, or impact occurring during the transportation of the linear compressor 10.

In particular, the suction stopper 102*b* may be placed adjacent to the rear cover 170. Thus, when the linear compressor 10 is shaken, the rear cover 170 interferes with the suction stopper 102*b*, and thus it is possible to prevent an impact from being directly transferred to the motor assembly 140.

The second supporting device 180 includes a pair of discharge support parts 181 that extend radially. The discharge support part 181 has one end fixed to the discharge cover 191 and the other end brought into close contact with the inner circumferential surface of the shell 101. Thus, the discharge support part 181 may radially support the compressor body.

For example, the pair of discharge support parts 181 are placed at an interval of 90 to 120 degrees with respect to each other circumferentially around a lower end closest to the bottom surface. That is, the discharge support parts 181 may support a lower portion of the compressor body at two points.

Also, the second supporting device 180 may include a discharge spring (not shown) axially installed. For example, the discharge spring (not shown) may be placed between the second shell cover and an upper end of the discharge cover 191.

A refrigerant compression process will be described based on such a configuration. As the linear compressor 10 is operated, the piston 130 reciprocates axially inside the cylinder 120. That is, when power is input to the motor assembly 140, the piston 130 may move along with the permanent magnet 146.

Thus, refrigerant may be suctioned into the shell 101 through the suction pipe 104. Also, the suction refrigerant flows into the piston 130 through the muffler 150.

In this case, when the pressure of the compression space P is less than or equal to the suction pressure of the refrigerant, the suction valve 135 is deformed to open the compression space P. Thus, the suction refrigerant accommodated inside the piston 130 may flow into the compression space P.

Also, when the pressure of the compression space P is greater than or equal to the suction pressure of the refrigerant, the compression space P is closed by the suction valve 135. Thus, the refrigerant accommodated inside the compression space P may be compressed by advancing the piston 130.

Also, when the pressure of the compression space P is greater than or equal to the pressure of the discharge space D, the valve spring is deformed forward, and thus the discharge valve 161 is separated from the cylinder 120. That is, the compression space P is opened by the discharge valve 161. Accordingly, the refrigerant compressed in the compression space P flows into the discharge space D through a separated space between the discharge valve 161 and the cylinder 120.

Also, when the pressure of the compression space P is less then or equal to the pressure of the discharge space D, the valve spring 164 provides a restoring force to the discharge valve 161, and the discharge valve 161 is brought into close contact with the front end of the cylinder 120 again. That is, the compression space P is closed by the discharge valve 161.

The refrigerant having flown into the discharge space D is discharged to the outside of the shell 101 through the cover pipe 195 and the discharge pipe 105 in sequence. In this way, the refrigerant discharged from the linear compressor 10 may be circulated by being suctioned into the linear compressor 10 through a predetermined device.

In this case, the compression space P and the discharge space D may be provided to communicate with each other by coupling the discharge unit 190 and the frame 110. The discharge unit 190 and the frame 110 will be described below in detail.

Figure 4:
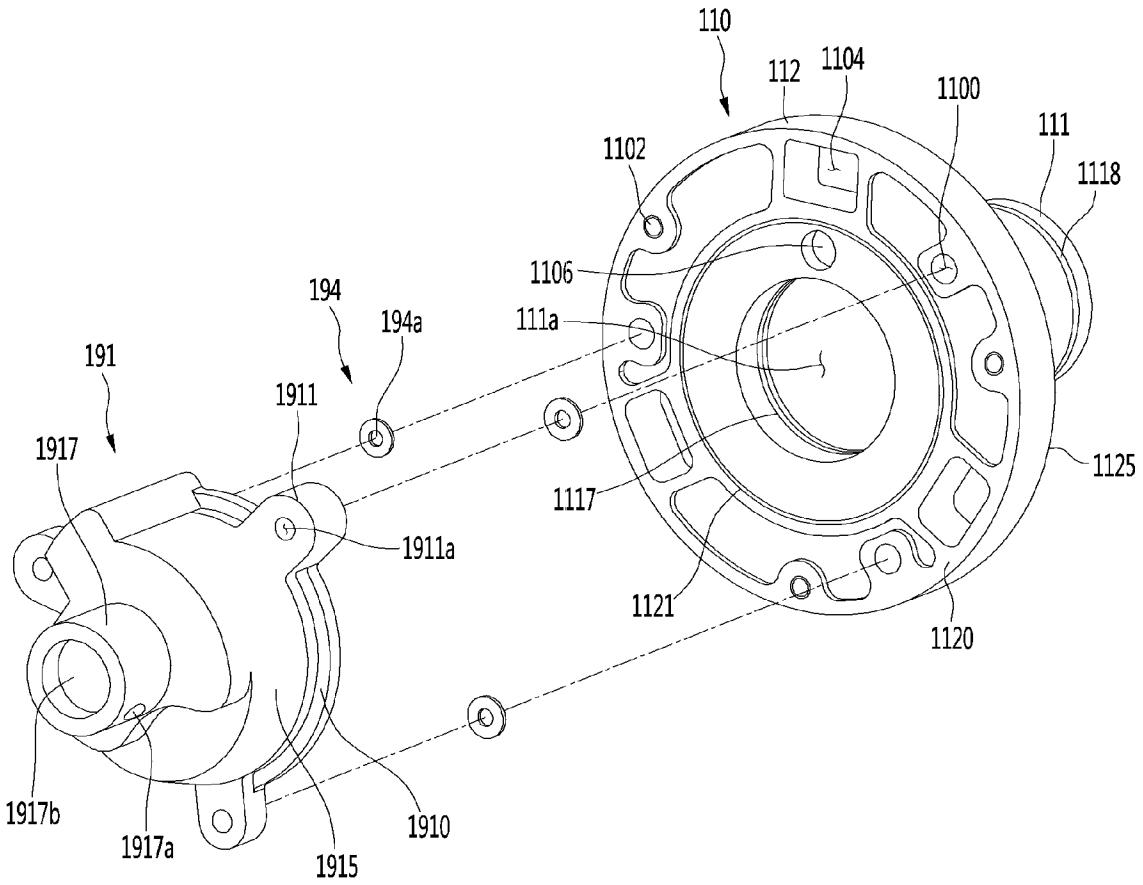
FIG. 4 is a view showing a frame and a discharge unit of a linear compressor according to an embodiment of the present invention.

FIG. 4 is a view showing a frame and a discharge unit of a linear compressor according to an embodiment of the present invention.

As shown in FIG. 4, the discharge cover 191 and the frame 110 may be coupled to each other through a predetermined fastening member (not shown). In particular, the discharge cover 191 and the frame 110 may be supported at three points and coupled to each other.

The frame 110 includes a frame body 111 extending axially and a frame flange 112 extending outward radially from the frame body 111. In this case, the frame body 111 and the frame flange 112 may be integrated.

The frame body 111 may be provided in the form of a cylinder having axially upper and lower ends opened. Also, a cylinder accommodation part 111*a* for accommodating the cylinder 120 is provided inside the frame body 111. Thus, the cylinder 120 is accommodated in a radially inner side of the frame body 111, and at least a portion of the piston 130 is accommodated in a radially inner side of the cylinder 120.

Also, sealing member insertion parts 1117 and 1118 are formed in the frame body 111. The sealing member insertion parts include a first sealing member insertion part 1117 formed inside the frame body 111, the first sealing member 129*a* being inserted into the first sealing member insertion part 1117. Also, the sealing member insertion parts include a third sealing member insertion part 1118 formed on the outer circumferential surface of the frame body 111, the third sealing member 129*c* being inserted into the third sealing member insertion part 1118.

Also, the inner stator 148 is coupled to a radially outer side f the frame body 111. Also, the outer stator 141 is placed at a radially outer side of the inner stator 148, and the permanent magnet 146 is movably placed between the inner stator 148 and the outer stator 141.

The frame flange 112 is axially provided in the shape of a disc having a predetermined thickness. In detail, the frame flange 112 is axially provided in the form of a ring having a predetermined thickness due to the cylinder accommodation part 111*a* provided at a radial center.

In particular, the frame flange 112 radially extends from the front end of the frame body 111. Accordingly, the outer stator 141, the permanent magnet 146, and the inner stator 148 placed at the radially outer side of the frame body 111 are placed axially further backward than the frame flange 112.

Also, a plurality of openings are formed to axially pass through the frame flange 112. In this case, a discharge fastening hole 1100, a stator fastening hole 1102, and an terminal insertion hole 1104 are included in the plurality of openings.

A predetermined fastening member (not shown) for fastening the discharge cover 191 and the frame 110 is inserted into the discharge fastening hole 1100. In detail, the fastening member (not shown) may be inserted into the front of the frame flange 112 through the discharge cover 191.

The cover fastening member 149*a* is inserted into the stator fastening hole 1102. The cover fastening member 149*a* may couple the stator cover 149 to the frame flange 112 to axially fix the outer stator 141 placed between the stator cover 149 and the frame flange 112.

A terminal part 141*d* of the outer stator 141 may be inserted into the terminal insertion hole 1104. That is, the terminal part 141*d* may be drawn or exposed to the outside through the terminal insertion hole 1104 in a direction from the rear side to the front side of the frame 110.

In this case, the discharge fastening hole 1100, the stator fastening hole 1102, and the terminal insertion hole 1104 may be provided in plural and may be circumferentially and sequentially spaced apart from one another. For example, the discharge fastening hole 1100, the stator fastening hole 1102, and the terminal insertion hole 1104 may be provided as three fastening holes 1100, three stator fastening holes 1102, and three terminal insertion holes 1104, which may be circumferentially placed at intervals of 120 degrees.

Also, the terminal insertion hole 1104, the discharge fastening hole 1100, and the stator fastening hole 1102 may be circumferentially separated apart from one another in sequence. Also, adjacent openings may be circumferentially separated apart from one another at intervals of 30 degrees.

For example, the terminal insertion hole 1104 and the discharge fastening hole 1100 is circumferentially separated apart from each other at an interval of 30 degrees. Also, the discharge fastening hole 1100 and the stator fastening hole 1102 are circumferentially spaced apart from each other at an interval of 30 degrees. The terminal insertion hole 1104 and the stator fastening hole 1102 may be circumferentially spaced apart from each other at an interval of 60 degrees.

The spacing is based on circumferential centers of the terminal insertion hole 1104, the discharge fastening hole 1100, and the stator fastening hole 1102.

In this case, the front surface of the frame flange 112 is referred to as a discharge frame surface 1120, and the rear surface of the frame flange 112 is referred to as a motor frame surface 1125. That is, the discharge frame surface 1120 and the motor frame surface 1125 corresponding to surfaces that are axially opposite to each other. In detail, the discharge frame surface 1120 corresponding to a surface being in contact with the discharge cover 191. Also, the motor frame surface 1125 corresponds to a surface being in contact with the outer stator 141.

A fourth sealing member insertion part 1121 into which the fourth sealing member 129*d* is to be inserted is formed on the discharge frame surface 1120. In detail, the fourth sealing member insertion part 1121 is provided in a ring shape and is axially recessed backward from the discharge frame surface 1120.

Also, the fourth sealing member 129*d* is provided in the shape of a ring with a diameter corresponding to the fourth sealing member insertion part 1121. The fourth sealing member 129*d* may prevent refrigerant from leaking into a gap between the discharge cover 191 and the frame 110.

Also, a gas hole 1106 communicating with a gas flow path, which will be described below, is formed on the discharge frame surface 1120. The gas hole 1106 is axially recessed backward from the discharge frame surface 1120. Also, the gas hole may be equipped with a gas filter 1107 (see FIG. 10) for filtering out foreign substances contained in a flowing gas.

In this case, the gas hole 1106 is radially formed further inward than the fourth sealing member insertion part 1121. Also, the terminal insertion hole 1104, the discharge fastening hole 1100, and the stator fastening hole 1102 are radially formed further outward than the fourth sealing member insertion part 1121.

Also, referring to FIG. 4, a predetermined recess structure may be formed on the discharge frame surface 1120. This structure is to prevent heat of discharge refrigerant from being transferred and has no limitations on a recessed depth and shape.

As described above, the discharge unit 190 includes the discharge cover 191, the discharge plenum 192, and the fixing ring 193. An outer shape of the discharge cover 191 coupled to the frame 110 will be described below. An inner shape of the discharge cover 191, the discharge plenum 192, and the fixing ring 193 will be described in detail later.

The outside of the discharge cover 191 may be provided in a ball shape as a whole. In detail, the discharge cover 191 may be provided in a shape with one open surface and an inner space formed therein. In particular, the discharge cover 191 may be placed such that an axially rear side is open. In this case, the discharge plenum 192 is placed in the inner space.

The discharge cover 191 includes a cover flange part 1910 coupled to the frame 110, a chamber part 1915 extending axially forward from the cover flange part 1910, and a supporting device fixing part 1917 extending axially forward from the chamber part 1915.

The cover flange part 1910 is brought into close contact with, and coupled to, the front surface of the frame 110. In detail, the cover flange part 1910 is brought into close contact with the discharge frame surface 1120.

Also, the cover flange part 1910 has a predetermined axial thickness and extends radially. Thus, the cover flange part 1910 may be provided in a disc shape as a whole.

In particular, the cover flange part 1910 may have a diameter corresponding to the fourth sealing member insertion part 1121. In detail, the cover flange part 1910 has a slightly greater diameter than the fourth sealing member insertion part 1121.

That is, the cover flange part 1910 has a significantly smaller diameter than the discharge frame surface 1120. For example, the diameter of the cover flange part 1910 may be equal to 0.6 to 0.8 times the diameter of the discharge frame surface 1120. In conventional linear compressors, the diameter of the cover flange part is greater than or equal to 0.9 times the diameter of the discharge frame surface.

Such a structure is to minimize heat transferred from the cover flange part 1910 to the frame 110. In detail, as the cover flange part 1910 is brought into close contact with the discharge frame surface 1120, heat of the discharge cover 191 may be conducted to the frame 110 through the cover flange part 1910.

In this case, since heat conduction is proportional to a contact area, the amount of heat changes depending on a contact area between the cover flange part 1910 and the discharge frame surface 1120. That is, it is possible to minimize the diameter of the cover flange part 1910 and also minimize a contact surface with the discharge frame surface 1120. Thus, it is possible to minimize the amount of heat conducted from the discharge cover 191 to the frame 110.

In addition, as an area being in contact with the cover flange part 1910 decreases, a significantly large portion of the discharge frame surface 1120 may be exposed to the inside of the shell 101.

The surface exposed to the inside of the shell 101 is brought into contact with the refrigerant accommodated inside the shell 101 (shell refrigerant), and thus heat transfer occurs. In particular, since the shell refrigerant and the suction refrigerant are provided at similar temperatures, convection heat transfer occurs from the frame 110 to the shell refrigerant. Also, since the convention heat transfer is proportional to a contact area, heat dissipation increases as the surface exposed to the inside of the shell 101 increases.

In summary, as the area of the cover flange part 1910 decreases, the amount of heat conducted to the frame 110 through the discharge cover 191 decreases. Also, it is possible to effectively make heat dissipation from the frame 110 to the shell refrigerant.

Accordingly, the temperature of the frame 110 may be kept relatively low. Also, the amount of heat transferred to the piston 130 and the cylinder 120 placed inside the frame 110 decreases. As a result, it is possible to prevent an increase in temperature of the suction refrigerant and also improve compression efficiency.

An opening for communicating through an axially open rear side is formed at the center of the cover flange part 1910. The discharge plenum 192 may be installed inside the discharge cover 191 through such an opening. Also, the opening may be understood as an opening in which the discharge valve assembly 160 is installed.

Also, the cover flange part 1910 includes a flange fastening hole 1911*a* through which a fastening member (not show) passes in order to couple the cover flange part 1910 to the frame 110. The flange fastening hole 1911*a* has a plurality of flange fastening holes 1911*a* formed to axially pass through the cover flange part 1910.

In particular, the flange fastening holes 1911*a* may be provided in size, number, and location corresponding to the discharge fastening hole 1100. Accordingly, three flange fastening holes 1911*a* may be circumferentially spaced apart from one another at intervals of 120 degrees.

In this case, the discharge cover 191 includes a cover fastening part 1911 radially protruding from the cover flange part 1910 and forming the flange fastening hole 1911*a*. That is, the flange fastening holes 1911*a* are placed at a radial outer side of the cover flange part 1910. In other words, the discharge fastening hole 1100 may be located at a radial outer side of the cover flange part 1910.

The three cover fastening parts 1911 may be circumferentially spaced apart from one another at intervals of 120 degrees, corresponding to the flange fastening holes 1911*a*. Also, the edge of the cover fastening part 1911 may be axially thicker than the cover flange part 1910. This can be understood to prevent breakage because a comparatively large external force is applied to the flange fastening hole 1911*a*, which is a part coupled by a fastening member.

The chamber part 1915 and the supporting device fixing part 1917 may have a cylindrical external appearance. In detail, each of the chamber part 1915 and the supporting device fixing part 1917 radially has a predetermined outer diameter, and extends axially. In this case, the outer diameter of the supporting device fixing part 1917 is smaller than the outer diameter of the chamber part 1915.

Also, the outer diameter of the chamber part 1915 is smaller than the outer diameter of the cover flange part 1910. That is, the discharge cover 191 has a stepped portion with an outer diameter sequentially decreasing toward an axially front side.

Also, he chamber part 1915 and the supporting device fixing part 1917 has a rear side axially opened. Thus, each of the chamber part 1915 and the supporting device fixing part 1917 has an outer appearance with a cylindrical side surface and a circular front surface.

The chamber part 1915 may further include a pipe coupling part (not shown) to which the cover pipe 195 is to be coupled. In particular, the cover pipe 195 may be coupled to the chamber part 1915 to communicate with any one of a plurality of discharge spaces D. In detail, the cover pipe 195 may communicate with a discharge space D through which refrigerant finally passes.

Also, at least a portion of an upper surface of the chamber part 1915 may be recessed in order to avoid interference to the cover pipe 195. Thus, when the cover pipe 195 is coupled to the chamber part 1915, the cover pipe 195 may be prevented from being in contact with the front surface of the chamber part 1915.

Fixed fastening parts 1917*a* and 1917*b* to which the second supporting device 180 is coupled are formed at the supporting device fixing part 1917. The fixed fastening parts include a first fixed fastening part 1917*a* to which the discharge support part 181 is to be coupled and a second fixed fastening part 1917*b* to which the discharge spring (not shown) is to be installed.

The first fixed fastening part 1917*a* may be radially recessed inward from, or may pass through, the outer surface of the supporting device fixing part 1917. Also, the first fixed fastening part 1917*a* has a pair of first fixed fastening parts circumferentially separated apart from each other, which correspond to a pair of discharge support parts 181.

The second fixed fastening part 1917*b* may be axially recessed backward from the front surface of the supporting device fixing part 1917. Thus, at least a portion of the discharge spring (not shown) may be inserted into the second fixed fastening part 1917*b*.

In this case, the discharge cover 191 according to the spirit of the present invention is produced as one body through aluminum die casting. Accordingly, unlike conventional discharge covers, a welding process for the discharge cover 191 of the present invention may be omitted. Accordingly, it is possible to simplify a process of producing the discharge cover 191 and as a result, minimize product failures and reduce product costs. Also, it is possible to prevent leakage of refrigerant because there is no dimensional tolerance due to welding.

Thus, the cover flange part 1910, the chamber part 1915, and the supporting device fixing part 1917 are integrally formed and may be understood as being distinguished from one another for convenience of description.

Also, the linear compressor 10 includes a gasket placed between the frame 110 and the discharge cover 191. In detail, the gasket 194 is placed between the cover fastening part 1911 and the discharge frame surface 1120.

In particular, the gasket 194 may be located at a place where the frame 110 and the discharge cover 191 are to be fastened to each other. That is, the gasket 194 is understood as an element for tightly fastening the frame 110 and the discharge cover 191.

The gasket 194 may include a plurality of gaskets 194. In particular, the plurality of gaskets 194 are provided in number and location corresponding to the flange fastening hole 1911*a* and the discharge fastening hole 1100. That is, the plurality of gaskets 194 may include three gaskets 194 circumferentially spaced apart from one another at intervals of 120 degrees.

Also, the gasket 194 is provided in a ring shape in which a gasket through-hole 194*a* is formed at the center. The gasket through-hole 194*a* may have a size corresponding to the flange fastening hole 1911*a* and the discharge fastening hole 1100.

Also, the outer diameter of the gasket 194 may be smaller than the outside of the cover fastening part 1911. Accordingly, when the gasket through-hole 194*a* is placed to match the flange fastening hole 1911*a*, the gasket 194 may be located inside the cover fastening part 1911.

The discharge cover 191, the gasket 194, and the frame 110 are stacked such that the flange fastening hole 1911*a*, the gasket through-hole 194*a*, and the discharge fastening hole 1100 are axially placed downward in sequence. Also, as a fastening member passes through the flange fastening hole 1911*a*, the gasket through-hole 194*a*, and the discharge fastening hole 1100, the discharge cover 191, the gasket 194, and the frame 110 may be coupled to one another.

An inner shape of the discharge cover 191, the discharge plenum 192, and the fixing ring 193 will be described in detail below.

Figure 5:
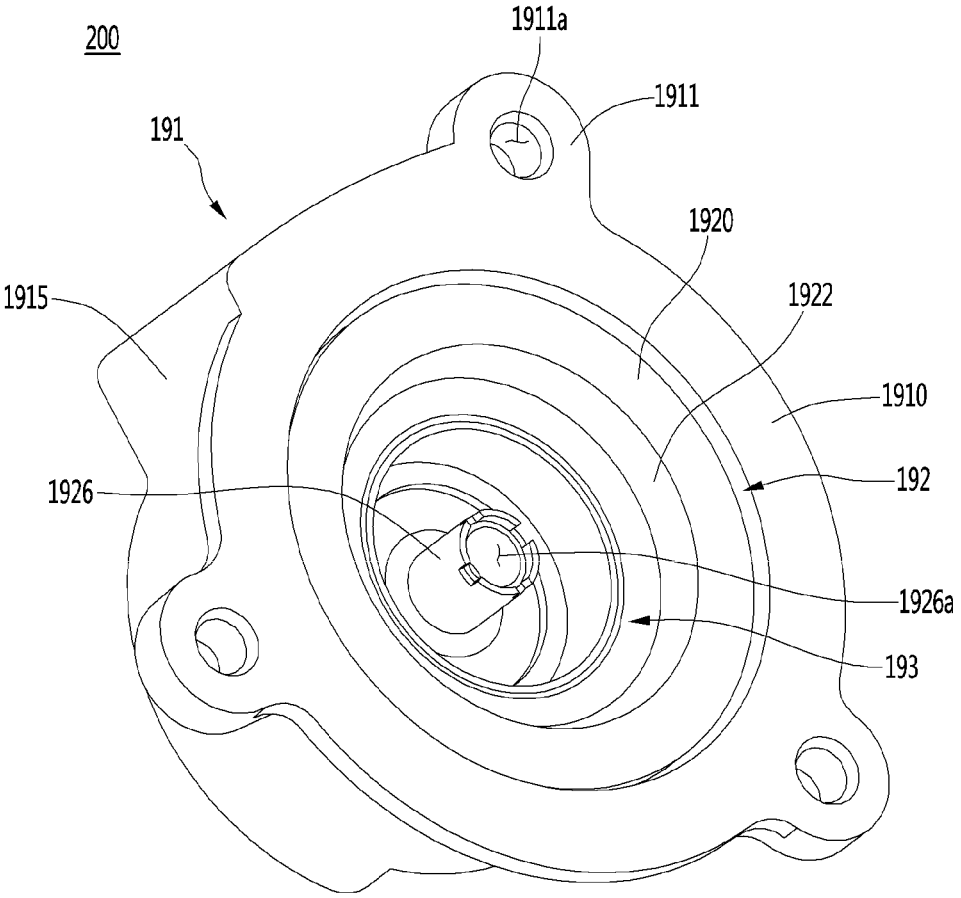
FIG. 5 is a view showing a discharge unit of a linear compressor according to an embodiment of the present invention.
Figure 6:
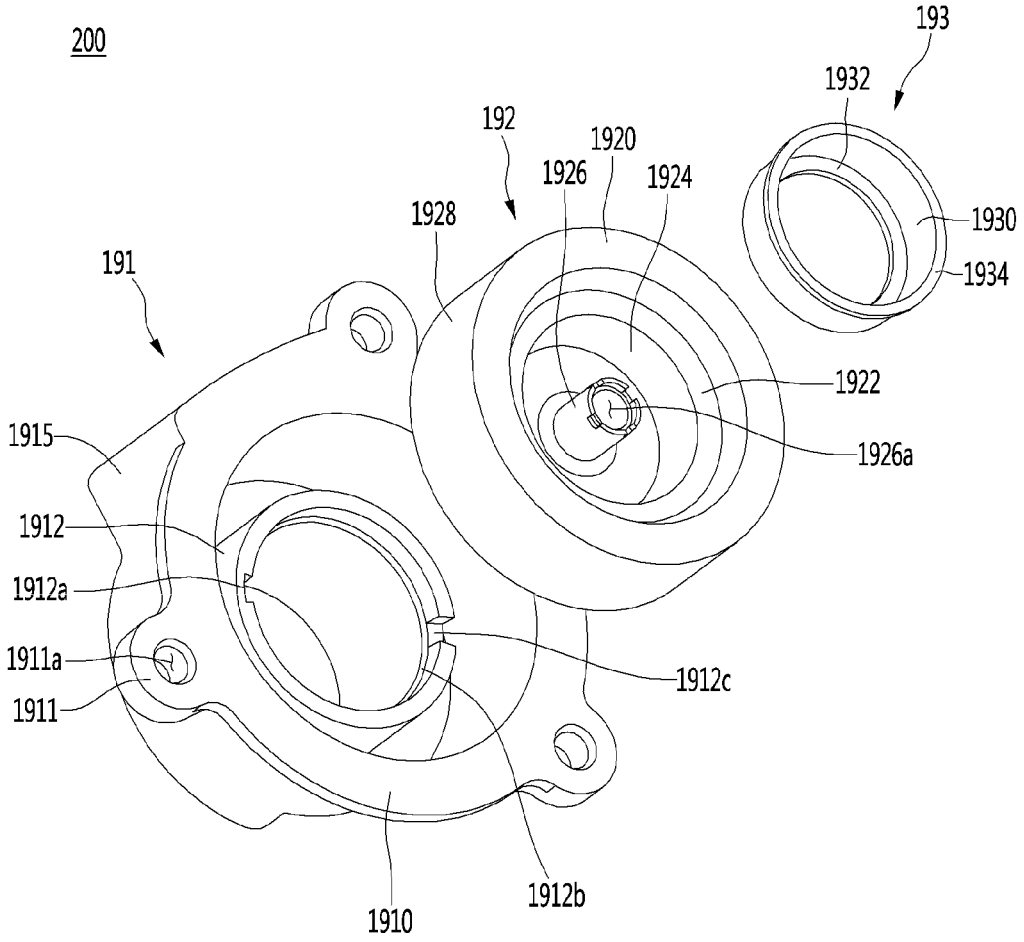
FIG. 6 is an exploded perspective view showing a discharge unit of a linear compressor according to an embodiment of the present invention.
Figure 7:
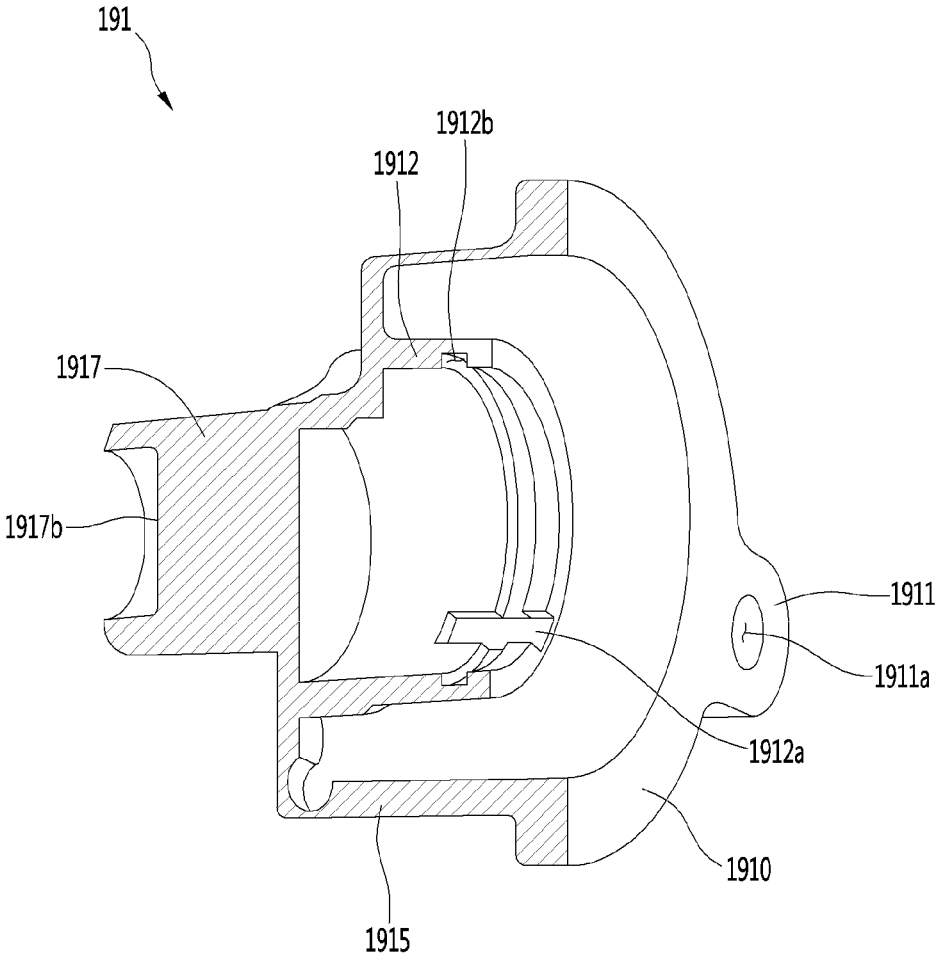
FIG. 7 is a sectional view of a discharge cover of a linear compressor according to an embodiment of the present invention.
Figure 8:
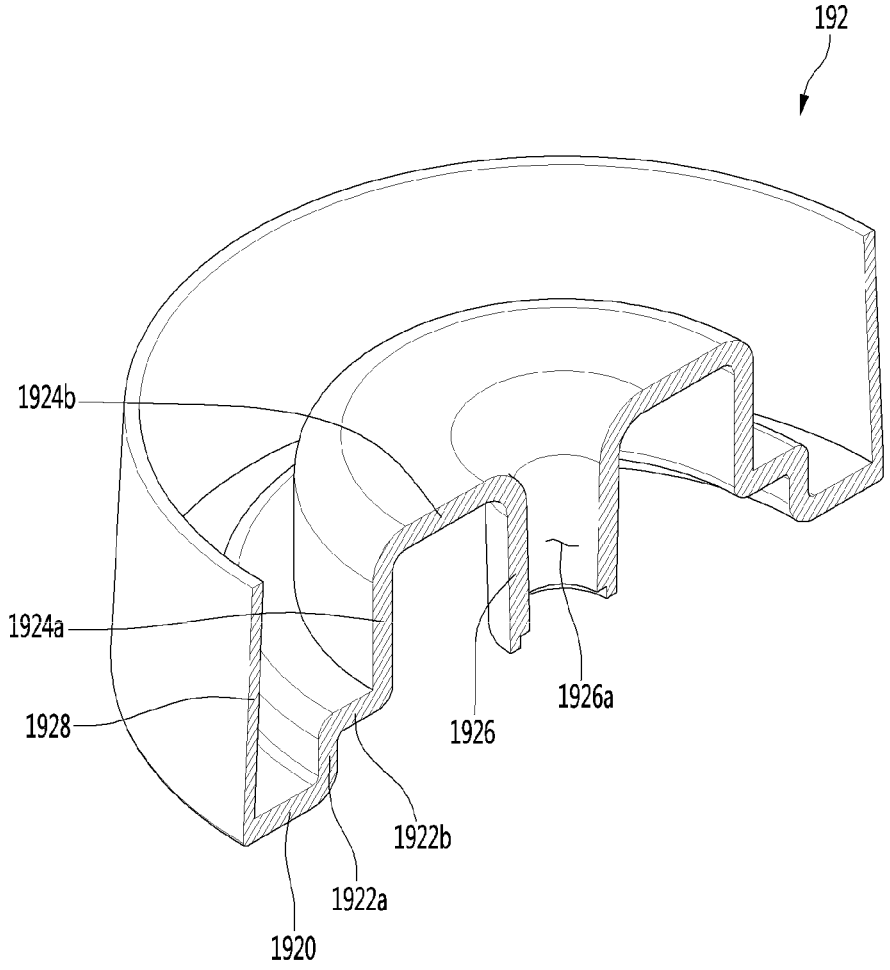
FIG. 8 is a sectional view of a discharge plenum of a linear compressor according to an embodiment of the present invention.

FIG. 5 is a view showing a discharge unit of a linear compressor according to an embodiment of the present invention, and FIG. 6 is an exploded perspective view showing a discharge unit of a linear compressor according to an embodiment of the present invention. Also, FIG. 7 is a sectional view of a discharge cover of a linear compressor according to an embodiment of the present invention, and FIG. 8 is a sectional view of a discharge plenum of a linear compressor according to an embodiment of the present invention.

For the sake of understanding, FIGS. 5 and 6 show the axially rear side of the discharge unit 190. Also, FIGS. 7 and 8 show sections obtained by cutting the discharge cover 191 and the discharge plenum 192 along their axial centers.

As shown in FIGS. 5 and 6, the discharge unit 190 includes the discharge cover 191, the discharge plenum 192, and the fixing ring 193. In this case, the discharge cover 191, the discharge plenum 192, and the fixing ring 193 may be made of different materials and in different producing methods.

The discharge plenum 192 is coupled to the inside of the discharge cover 191, and the fixing ring 193 is coupled to the inside of the discharge plenum 192 In particular, a plurality of discharge spaces D are formed by coupling the discharge cover 191 and the discharge plenum 192. The discharge spaces D may be understood as a space where refrigerant discharged from the compression space P flows.

First, the inner shape of the discharge cover 191 will be described with reference to FIGS. 6 and 7. As described above, the discharge cover 191 may be provided in a shape with one open surface and an inner space formed therein. In particular, the inner space may be formed inside the chamber part 1915 and the cover flange part 1910.

Also, the inner space may be divided into an upper space located in the axially upper side of a plenum flange 1920 of the discharge plenum 192, which will be described below, and a lower space located in the axially lower side of the plenum flange 1920. In this case, the upper space may correspond to a discharge space D.

Also, the upper space, that is, the discharge space D may be understood as being formed inside the chamber part 1915, and the lower space may be understood as being formed inside the cover flange part 1910.

The lower space corresponds to a space where the discharge valve assembly 160 is installed. The frame 110 is placed at a lower end of the lower space. In detail, the lower space is formed at an upper side of the discharge frame surface 1120. Also, the lower space may correspond to a space in which bearing refrigerant flows. The bearing refrigerant will be described in detail later.

Also, the upper space and the lower space may be formed as a single cylindrical shape that extends axially. In this case, a radial diameter of a space formed by the upper space and the lower space is referred to as an inner diameter R (see FIG. 9) of the discharge cover 191. Also, the inside of the discharge cover 191 may be stepped in order to fix the discharge plenum 192.

Also, the discharge cover 191 includes a partition sleeve 1912 for partitioning the upper space. The partition sleeve 1912 may be formed in a cylindrical shape that axially extends inside the upper space. In particular, the partition sleeve 1912 may extend axially backward from the front surface of the chamber part 1915.

Also, the outer diameter of the partition sleeve 1912 is smaller than the inner diameter R of the discharge cover 191. In detail, the partition sleeve 1912 is radially spaced apart from the inner side surface of the discharge cover 191 so that a predetermined space is formed between the partition sleeve 1912 and the inner side surface of the discharge cover 191.

Thus, the upper space may be divided into a radially inner side and a radially outer side by the partition sleeve 1912. In this case, a first discharge chamber D1 and a second discharge chamber D2 are formed in the radially inner side of the partition sleeve 1912. Also, a third discharge chamber D3 is formed at the radially outer side of the partition sleeve 1912.

Also, the discharge plenum 192 may be fit into the partition sleeve 1912. In detail, at least a portion of the discharge plenum 192 may be brought into close contact with the inner side surface of, and inserted into, the partition sleeve 1912.

Also, a first guide hole 1912*a*, a second guide hole 1912*b*, and a third guide hole 1912*c* may be formed in the partition sleeve 1912.

The first guide hole 1912*a* may be radially recessed outward on the inner side surface of the partition sleeve 1912 and may axially extend. In particular, the first guide hole 1912*a* axially further extends backward than a position where the discharge plenum 192 is inserted.

The second guide hole 1912*b* may be radially recessed outward on the inner side surface of the partition sleeve 1912 and may circumferentially extend. In particular, the second guide hole 1912*b* is formed on the inner side surface of the partition sleeves 1912 brought into contact with the discharge plenum 192. Also, the second guide hole 1912*b* may be formed to communicate with the first guide hole 1912*a*.

The third guide hole 1912*c* may be axially recessed forward from the axially rear end of the partition sleeve 1912. Thus, the rear end of the partition sleeve 1912 may be stepped. Also, the third guide hole 1912*c* may be formed to communicate with the second guide hole 1912*b*.

That is, the third guide hole 1912*c* may be recessed up to a place where the second guide hole 1912*b* is formed. Also, the third guide hole 1912*c* and the first guide hole 1912*a* may be circumferentially spaced apart from each other. For example, the third guide hole 1912*c* may face the first guide hole, that is, may be spaced apart from the first guide hole at an interval of 180 degrees.

Such a structure may increase a time during which refrigerant flowing into the second guide hole 1912*b* stays in the second guide hole 1912*b*. Thus, it is possible to effectively reduce pulsation noise of the refrigerant.

The discharge plenum 192 will be described below with reference to FIGS. 6 and 8.

The discharge plenum 192 includes a plenum flange 1920, a plenum seating part 1922, a plenum body 1924, a plenum extension part 1926, and a plenum guide surface 1928. In this case, the discharge plenum 192 may be formed as one body by using engineering plastic. That is, elements of the discharge plenum 192, which will be described below, are distinguished for convenience of description.

Also, the element of the discharge plenum 192 may be formed to the same thickness. Thus, the plenum flange 1920, the plenum seating part 1922, the plenum body 1924, the plenum extension part 1926, and the plenum guide surface 1928 may be provided in a shape extending to the same thickness.

The plenum flange 1920 forms the axially lower surface of the discharge plenum 192. That is, the plenum flange 1920 is axially located at the bottom of the discharge plenum. In detail, the plenum flange 1920 may be provided in a ring shape having an axial thickness and extending radially.

In this case, the outer diameter of the plenum flange 1920 corresponds to the inner diameter R of the discharge cover 191. In this case, the outer diameter of the plenum flange 1920 corresponding to the inner diameter R of the discharge cover 191 means that the outer diameter is the same as, or is regarded as the same as, the inner diameter R of the discharge cover 191 in consideration of an assembly tolerance.

Thus, the plenum flange 1920 may be installed such that the outer side surface is brought into close contact with the inside of the discharge cover 191. As described above, the axially upper side of the plenum flange 1920 corresponds to the upper space, and the axially lower side of the plenum flange 1920 corresponds to the lower space.

In particular, the plenum flange 1920 is configured to close the axially rear side of the third discharge chamber D3. That is, as the plenum flange 1920 is seated inside the discharge cover 191, it is possible to prevent refrigerant of the third discharge chamber D3 from flowing axially backward.

The inner diameter of the plenum flange 1920 corresponds to the size of the spring assembly 163. In detail, the plenum flange 1920 may extend radially inward and adjacent to the outer side surface of the spring support part 165.

The plenum seating part 1922 extends radially inward from the plenum flange 1920 such that the spring assembly 163 is seated thereon. In detail, the plenum seating part 1922 is axially bent, and extends, forward from a radially inner side end of the plenum flange 1920, and then is radially bent inward and extends.

Accordingly, the plenum seating part 1922 is provided in a cylindrical shape in which one end located at an axially front side is radially bent inward as a whole. In this case, the plenum flange 1920 may be classified into a first plenum seating part 1922*a* extending axially forward and a second plenum seating part 1922*b* extending radially inward from the first plenum seating part 1922*a*.

The first plenum seating part 1922*a* extends axially forward along the outer side surface of the spring support part 165. In this case, the first plenum seating part 1922*a* may have a smaller axial length than the outer side surface of the spring support part 165. That is, at least a portion of the spring support part 165 is seated on the plenum seating part 1922.

In this case, the first plenum seating part 1922*a* is brought into contact with the friction ring 166. In detail, the friction ring 166 is installed such that at least a portion of the friction ring 166 protrudes from the outer circumferential surface. Thus, when the spring assembly 163 is seated in the plenum seating part 1922, the friction ring 166 may be brought into close contact with the first plenum seating part 1922*a*.

In particular, the friction ring 166 may be made of an elastic material, such as rubber, deformed by an external force. Thus, the friction ring 166 may prevent a gap from being formed between the first plenum seating part 1922*a* and the spring support part 165.

Also, the friction ring 166 may prevent the spring assembly 163 from circumferentially idling Also, the friction ring 166 may prevent the spring support part 165 from directly colliding with the discharge plenum 192, thus minimizing striking noise.

The second plenum seating part 1922*b* extends radially inward along the front surface of the spring support part 165. Also, the second plenum seating part 1922*b* is brought into contact with the axially rear end of the partition sleeve 1912.

In other words, the partition sleeve 1912 extends axially backward from a front inner side of the chamber part 1915 to the second plenum seating part 1922*b*. That is, the second plenum seating part 1922*b* may be understood as being axially placed between the spring support part 165 and the partition sleeve 1912.

In this case, the second plenum seating part 1922*b* is brought into close contact with the axially rear end of the partition sleeve 1912. That is, the plenum seating part 1922 and the partition sleeve 1912 are understood as being axially brought into close contact with each other. Thus, it is possible to prevent refrigerant from flowing into a gap between the second plenum seating part 1922*b* and the partition sleeve 1912.

As described above, the third guide hole 1912*c* is axially recessed forward from the rear end of the partition sleeve 1912. Thus, the refrigerant may flow into a gap between the partition sleeve 1912 and the second plenum seating part 1922*b* along the third guide hole 1912*c*. That is, the third guide hole 1912*c* forms a flow path of the refrigerant passing through the partition sleeve 1912 and the second plenum seating part 1922*b*.

The plenum body 1924 extends radially inward from the plenum seating part 1922 to form a first discharge chamber D1. In detail, the plenum body 1924 is axially bent, and extends, forward from a radially inner side end of the second plenum seating part 1922*b*, and then is radially bent inward and extends.

Accordingly, the plenum body 1924 is provided in a cylindrical shape in which one end located at an axially front side is radially bent inward as a whole. In this case, the plenum body 1924 may be classified into a first plenum body 1924*a* extending axially forward and a second plenum body 1924*b* extending radially inward from the first plenum body 1924*a*.

The first plenum body 1924*a* extends axially forward along the inner side surface of the partition sleeve 1912. In this case, the first plenum body 1924*a* may have a smaller axial length than the partition sleeve 1912. That is, the first plenum body 1924*a* is placed below the partition sleeve 1912.

In this case, the first plenum body 1924*a* is brought into close contact with the inner side surface of the partition sleeve 1912. That is, the plenum body 1924 and the partition sleeve 1912 are understood as being radially brought into close contact with each other. Thus, it is possible to prevent refrigerant from flowing into a gap between the first plenum body 1924*a* and the partition sleeve 1912.

As described above, the first and second seating holes 1912*a* and 1912*b* are recessed on the inner side surface of the partition sleeve 1912. Thus, the refrigerant may flow into a gap between the partition sleeve 1912 and the first plenum body 1924*a* along the first and second seating holes 1912*a* and 1912*b*. That is, the first and second seating holes 1912*a* and 1912*b* form a flow path of the refrigerant passing through the partition sleeve 1912 and the first plenum body 1924*a*.

The second plenum body 1924*b* radially extends inward from the axially front end of the first plenum body 1924*a*. In this case, the second plenum body 1924*b* is provided in a ring shape that radially extends inward from the axially front end of the first plenum body 1924*a*. That is, an opening is formed at the center of the second plenum body 1924*b*.

Also, the first discharge chamber D1 and the second discharge chamber D2 may be distinguished from each other on the basis of the second plenum body 1924*b*. In detail, the first discharge chamber D1 is formed at the axially rear side of the second plenum body 1924*b*, and the second discharge chamber D2 is formed at the axially front side of the second plenum body 1924*b*.

The plenum extension part 1926 extends axially backward from the radially inner end of the second plenum body 1924*b*. That is, the opening formed at the center of the second plenum body 1924*b* extends axially backward to form a predetermined passage.

The passage formed by the plenum extension part 1926 is referred to as a plenum guide part 1926*a*. The plenum guide part 1926*a* functions as a passage through which the refrigerant of the first discharge chamber D1 flows to the second discharge chamber D2. In particular, the refrigerant of the first discharge chamber D1 may flow axially forward along the plenum guide part 1926*a*.

Also, the plenum extension part 1926 may extend axially backward to come into contact with the spring assembly 163. In detail, the axially rear end of the plenum extension part 1926 may be brought into contact with the front surface of the spring support part 165. In other words, the plenum extension part 1926 may axially extend further backward than the second plenum seating part 1922*b*.

The plenum guide surface 1928 axially extends forward from the plenum flange 1920. In detail, the plenum guide surface 1928 axially extends forward from the radially outer end of the plenum flange 1920.

In this case, the plenum guide surface 1928 forms the radially outer side surface of the discharge plenum 192. That is, the plenum guide surface 1928 is radially located at the outermost of the discharge plenum 192.

In detail, the plenum guide surface 1928 may be provided in a cylindrical shape that axially extends. In this case, the outer diameter of the plenum guide surface 1928 corresponds to the inner diameter R of the discharge cover 191. In this case, the outer diameter of the plenum guide surface 1928 corresponding to the inner diameter R of the discharge cover 191 means that the outer diameter is the same as, or is regarded as the same as, the inner diameter R of the discharge cover 191 in consideration of an assembly tolerance.

Thus, the plenum guide surface 1928 may be installed such that the outer side surface is brought into close contact with the inside of the discharge cover 191. Accordingly, the plenum guide surface 1928 is spaced apart from the partition sleeve 1912 and placed at the radially outer side of the partition sleeve 1912. Also, the outer end of the plenum flange 1920 brought into close contact with the inside of the discharge cover 191 may be understood as a portion of the plenum guide surface 1928.

Also, the third discharge chamber D3 is located on the inner side surface of the plenum guide surface 1928. In this case, compressed high-temperature refrigerant flows in the third discharge chamber D3. The plenum guide surface 1928 is configured to prevent heat from being transferred from high-temperature refrigerant to the discharge cover 191.

In other words, the plenum guide surface 1928 is provided such that the side surface of the discharge unit 190 is thick. That is, the plenum guide surface 1928 may be brought into close contact with the inner side surface of the discharge cover 191 to form one side surface. Accordingly, the side surface of the discharge unit 190 becomes thicker by the radial thickness of the plenum guide surface 1928.

Thus, it is possible to conduct and convect a smaller amount of heat from the refrigerant flowing in the discharge space D. That is, the discharge unit 190 may be maintained at low temperature by receiving the smaller amount of heat. Also, a smaller amount of heat is transferred to the frame 110 coupled to the discharge unit 190.

Accordingly, the temperature of the frame 110 may be kept relatively low. Thus, the amount of heat transferred to the piston 130 and the cylinder 120 placed inside the frame 110 decreases. As a result, it is possible to prevent an increase in temperature of the suction refrigerant and also improve compression efficiency.

When the shape of the discharge plenum 192 is summarized, the plenum flange 1920 extends radially. Also, the plenum seating part 1922, the plenum body 1924, and the plenum extension part 1926 extend from the radially inner end of the plenum flange 1920. Also, the plenum guide surface 1928 extends toward the inner space from the radially outer end of the plenum flange 1920.

The fixing ring 193 will be described below with reference to FIG. 6.

The fixing ring 193 is inserted into the inner circumferential surface of the discharge plenum 192. Thus, it is possible to prevent the discharge plenum 192 form being separated from the discharge cover 191.

That is, the fixing ring 193 may be understood as an element for fixing the discharge plenum 192. In particular, the fixing ring 193 may be inserted into the inner circumferential surface of the plenum body 1924 by press pitting.

The fixing ring 193 is formed in a cylindrical shape with axially front and rear surfaces being opened. In detail, the fixing ring 193 includes a fixing ring body 1930 brought into close contact with the inner circumferential surface of the discharge plenum 192 and first and second fixing ring extension parts 1932 and 1934 extending radially from the fixing ring body 1930.

The fixing ring body 1930 is installed in close contact with the first plenum body 1924*a*. Also, the axial length of the fixing ring body 1930 may correspond to the axial length of the first plenum body 1924*a*.

The first fixing ring extension part 1932 extends radially inward from the axially front end of the fixing ring body 1930. Thus, the first fixing ring extension part 1932 may be brought into close contact with the second plenum body 1924*b*. The radial length of the first fixing ring extension part 1932 is less than the radial length of the second plenum body 1924*b*. That is, the first fixing ring extension part 1932 may be installed in close contact with a portion of the second plenum body 1924*b*.

The second fixing ring extension part 1934 extends radially inward from the axially rear end of the fixing ring body 1930. Thus, the second fixing ring extension part 1934 may be brought into close contact with the second plenum seating part 1922*b*. In detail, the second fixing ring extension part 1934 may be brought into close contact with a connection portion between the first plenum body 1924*a* and the second plenum seating part 1922*b*.

Also, the second fixing ring extension part 1934 may be brought into close contact with the front surface of the spring assembly 163. That is, the second fixing ring extension part 1934 is placed between the spring assembly 163 and the discharge plenum 192.

The fixing ring 193 may be made of a material with a terminal expansion coefficient larger than that of the discharge plenum 192. For example, the fixing ring 193 may be made of a stainless steel material, and the discharge plenum 192 is made of an engineering plastic material.

In this case, the fixing ring 193 may be formed to have a specific assembly tolerance with respect to the discharge plenum 192 at room temperature. In detail, the fixing ring 193 is produced such that the outer diameter of the fixing ring body 1930 is smaller than the inner diameter of the first plenum body 1924*a* at room temperature. Thus, the fixing ring 193 may be relatively easily coupled to the discharge plenum 192.

Also, when the linear compressor 10 is activated, heat is transferred from the refrigerant discharged from the compression space P and thus the discharge plenum 192 and the fixing ring 193 expands. In this case, the fixing ring 193 further expands than the discharge plenum 192, and thus may be brought into close contact with the discharge plenum 192. Thus, the discharge plenum 192 may be brought into strong and close contact with the discharge cover 191.

Also, the discharge plenum 192 is brought into strong and close contact with the discharge cover 191 by the fixing ring 193, and thus it is possible to prevent the refrigerant from leaking into a gap between the discharge cover 191 and the discharge plenum 192.

Base on such a configuration, the flow of refrigerant in the discharge space D will be described below in detail.

Figure 9:
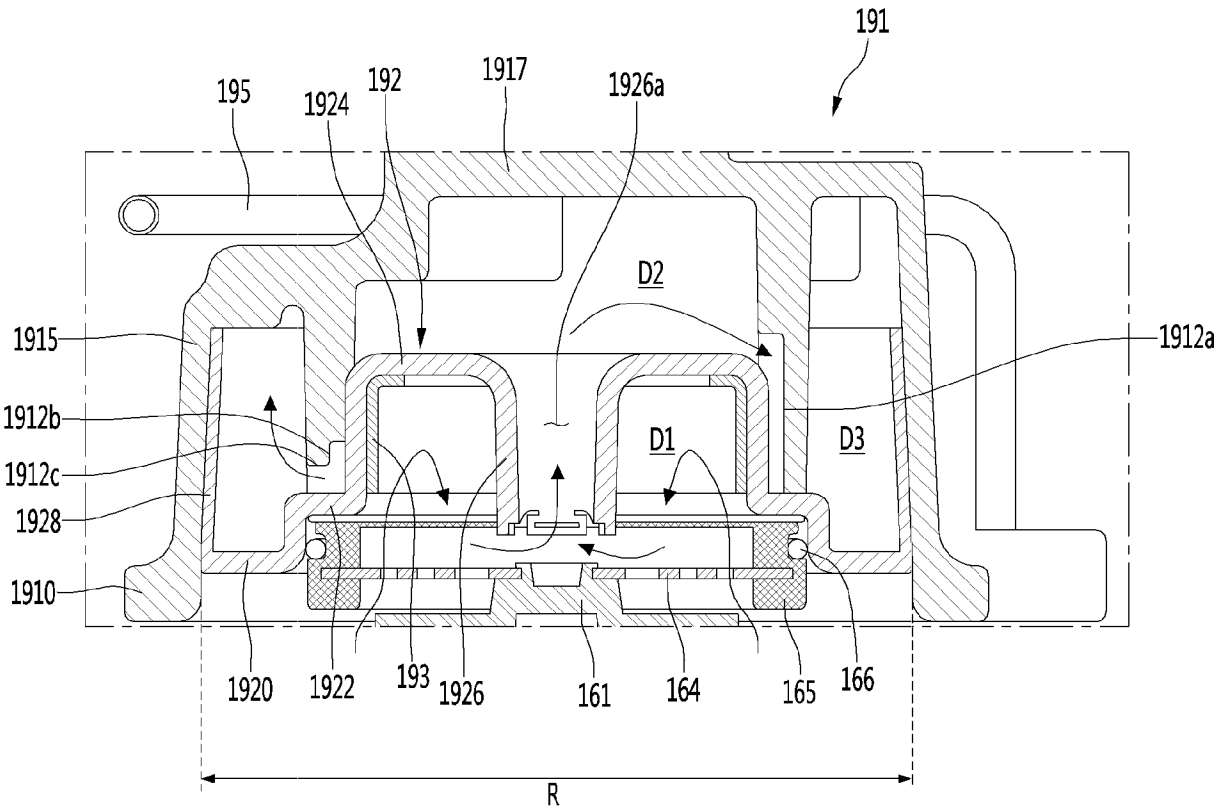
FIG. 9 is a view showing a part B of FIG. 3 together with a flow of refrigerant.

FIG. 9 is a view showing a part B of FIG. 3 together with a flow of refrigerant.

As shown in FIG. 9, the discharge space D is divided into a plurality of spaces. As described above, the discharge space D includes the first discharge chamber D1, the second discharge chamber D2, and the third discharge chamber D3.

Also, the first, second, and third discharge chamber D1, D2, and D3 may be formed by the discharge cover 191 and the discharge plenum 192. The first discharge chamber D1 is formed by the discharge plenum 192, and the second and third discharge chambers D2 and D3 are formed between the discharge plenum 192 and the discharge cover 191.

Also, the second discharge chamber D2 is formed at the axially front side of the first discharge chamber D1, and the third discharge chamber D3 is formed at the radially outer side of the first and second discharge chambers D1 and D2.

Also, the discharge cover 191, the discharge plenum 192, and the fixing ring 193 are coupled and brought into close contact with one another. Also, the discharge valve assembly 160 may be seated at the rear side of the discharge plenum 192.

When the pressure of the compression space P is greater than or equal to the pressure of the discharge space D, the valve spring 164 is elastically deformed toward the discharge plenum 192. Thus, the discharge valve 161 opens the compression space P so that the refrigerant compressed inside the compression space P may flow into the discharge space D. The refrigerant discharged from the compression space P when the discharge valve 161 opens the compression space P is guided to the first discharge chamber D1 through the valve spring 164.

The refrigerant guided to the first discharge chamber D1 is guided to the second discharge chamber D2 through the plenum guide part 1926*a*. In this case, the refrigerant of the first discharge chamber D1 is discharged to the second discharge chamber D2, which has a large sectional area, through the plenum guide part 1926*a*, which has a small sectional area. Thus, it is possible to significantly reduce noise due to refrigerant pulsation.

The refrigerant guided to the second discharge chamber D2 axially moves backward along the first guide hole 1912*a* and circumferentially moves along the second guide hole 1912*b*. Also, the refrigerant having moved circumferentially along the second guide hole 1912*b* is guided to the third discharge chamber D3 through the third guide hole 1912*c*.

In this case, the refrigerant of the second discharge chamber D2 is discharged to the third discharge chamber D3, which has a large sectional area, through the first guide hole 1912*a*, the second guide hole 1912*b*, and the third guide hole 1912*c*, which have small sectional areas. Thus, it is possible to further reduce noise due to refrigerant pulsation.

In this case, the third discharge chamber D3 is provided to communicate with the cover pipe 195. Accordingly, the refrigerant guided to the third discharge chamber D3 flows into the cover pipe 195. Also, the refrigerant guided to the cover pipe 195 may be discharged to the outside of the linear compressor 10 through the discharge pipe 105.

In this way, the refrigerant discharged from the compression space P may flow into the discharge space D formed at the discharge unit 190. In particular, the refrigerant discharged from the compression space P may pass through the first discharge chamber D1, the second discharge chamber D2, and the third discharge chamber D3 in sequence.

In this case, the linear compressor 10 has a structure functioning as a bearing using refrigerant. The refrigerant used as a bearing is hereinafter referred to as bearing refrigerant. The bearing refrigerant may correspond to some of the refrigerant discharged from the compression space P.

The flow of bearing refrigerant supplied to the frame 110, the cylinder 120, and the piston 130 will be described below.

Figure 10:
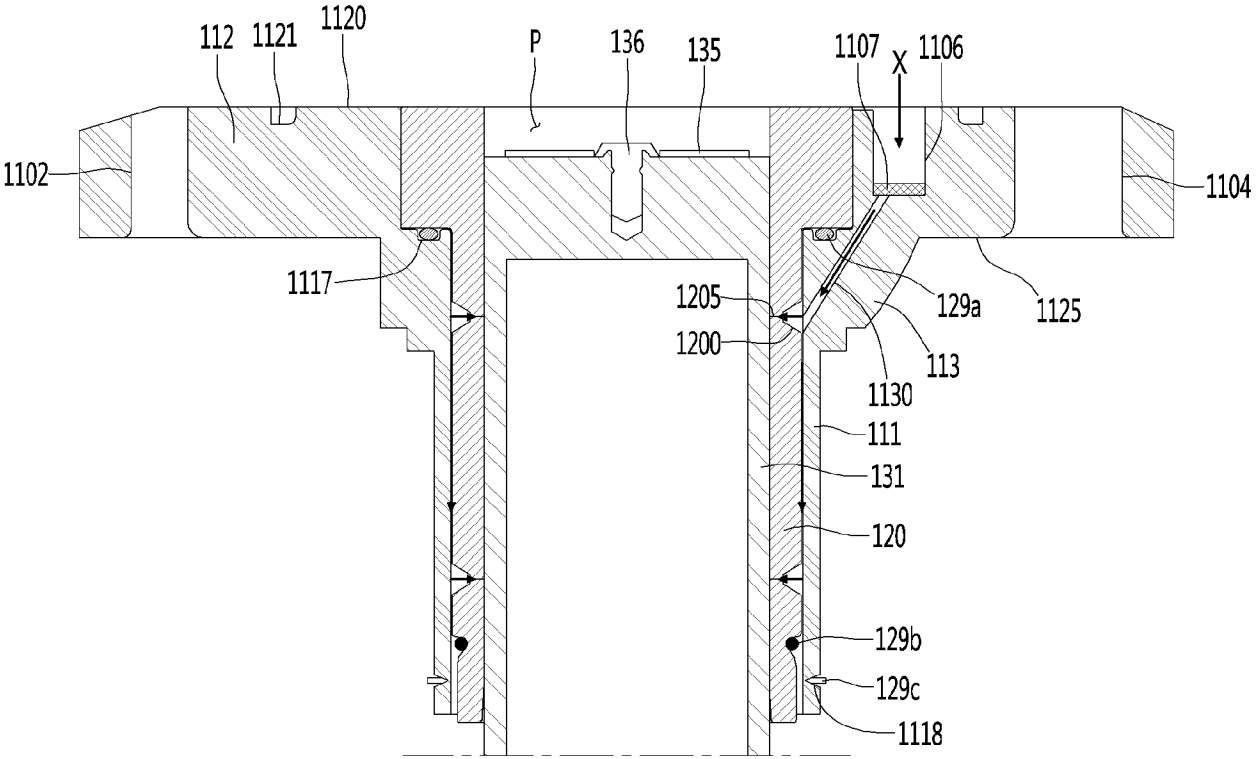
FIG. 10 is a view showing a part A of FIG. 3 together with a flow of bearing refrigerant.

FIG. 10 is a view showing a part A of FIG. 3 together with a flow of bearing refrigerant. In FIG. 10, in particular, elements unnecessary to describe the flow of bearing refrigerant have been omitted from the part A of FIG. 3.

As shown in FIG. 10, the frame 110 includes a frame connection part 113 extending obliquely from the frame flange 112 toward the frame body 111.

In this case, the frame connection part 113 includes a plurality of frame connection parts 113, which are circumferentially placed at regular intervals. For example, three frame connection parts 113 may be circumferentially formed at intervals of 120 degrees.

A gas flow path 1130 for guiding the refrigerant discharged from the compression space P to the cylinder 120 is formed at the frame connection part 113. In this case, the gas flow path 1130 may be formed at only one of the plurality of frame connection parts 113. Also, a frame connection part 113 where the gas flow path 1130 is not formed is understood as being included to prevent deformation of the frame 110.

The gas flow path 1130 may be formed to pass through the frame connection part 113. Also, the gas flow path 1130 may be inclined corresponding to the frame connection part 113. In particular, the gas flow path 1130 may extend from the frame flange 112 and also extend up to the frame body 111 via the frame connection part 113.

In detail, the gas flow path has one end connected to the gas hole 1106. As described above, the gas hole 1106 is axially recessed backward from the discharge frame surface 1120. Also, the gas filter 1107 may be installed at one side of the gas hole 1106 communicating with the gas flow path 1130.

For example, the gas hole 1106 may be formed in a cylindrical shape. Also, the gas filter 1107 may be provided as a circular filter and placed at the axially rear end of the gas hole 1106.

Also, the gas flow path 1130 has the other end communicating with the outer circumferential surface of the cylinder 120. In particular, the gas flow path 1130 may be formed to communicate with a gas inlet 1200 formed on the outer circumferential surface of the cylinder 120.

The gas inlet 1200 is radially recessed inward from the outer circumferential surface of the cylinder 120. In particular, the gas inlet 1200 may have an area decreasing radially inward. Thus, the radially inner end of the gas inlet 1200 may form a tip portion.

Also, the gas inlet 1200 circumferentially extends along the outer circumferential surface of the cylinder 120 to have a circular shape. Also, the gas inlet 1200 may include a plurality of gas inlets 1200 axially spaced apart from one another. For example, there may be two gas inlets 1200, one of which is placed to communicate with the gas flow path 1130.

A cylinder filter member (not shown) may be installed in the gas inlet 1200. The cylinder filter member (not shown) is configured to block foreign substances from flowing into the cylinder 120. Also, the cylinder filter member may be configured to adsorb oil contained in the refrigerant.

Also, the cylinder 120 includes a cylinder nozzle 1205 extending radially inward from the gas inlet 1200. In this case, the cylinder nozzle 1205 may extend up to the inner side surface of the cylinder 120. That is, the cylinder nozzle 1205 may be understood as a part communicating with the outer circumferential surface of the piston 130.

In particular, the cylinder nozzle 1205 extends from the radially inner end of the gas inlet 1200. That is, the cylinder nozzle 1205 may he formed to be very small.

Through such a structure, the flow of bearing refrigerant will be described. Some of the refrigerant discharged from the compression space P, that is, the bearing refrigerant flows through the gas hole 1106. In this case, the flow of bearing refrigerant flowing into the gas hole 1106 is referred to as a bearing flow path X.

The bearing refrigerant having flown into the gas hole 1106 through the bearing flow path X flows into the gas flow path 1130 through the gas filter 1107. Then, the bearing refrigerant flows into the gas inlet 1200 through the gas flow path 1130 such that the bearing refrigerant may be distributed along the outer side surface of the cylinder 120.

Also, some of the bearing refrigerant may flow into the outer side surface of the piston 130 through the cylinder nozzle 1205. The bearing refrigerant having flown to the outer side surface of the piston 130 may be distributed along the outer side surface of the piston 130.

Due to the bearing refrigerant distributed on the outer side surface of the piston 130, a fine space is formed between the piston 130 and the cylinder 120. That is, the bearing refrigerant provides a buoyancy force to the piston 130 to function as a gas bearing for the piston 130.

Thus, it is possible to prevent abrasion of the piston 130 and the cylinder 120 due to the reciprocating movement of the piston 130. That is, by using the bearing refrigerant, it is possible to implement the bearing function without using oil.

In this case, the refrigerant discharged from the compression space P flows through the bearing flow path X. In other words, the refrigerant flowing in the discharge space D also flows through the bearing flow path X. In particular, the refrigerant flowing in the third discharge space D3 may flow through the bearing flow path X.

In this case, the refrigerant flowing in the third discharge space D3 corresponds to compressed high-temperature refrigerant. When such refrigerant is used as the bearing refrigerant to flow into the frame 110, the cylinder 120, and the piston 130, the frame 110, the cylinder 120, and the piston 130 may increase in temperature. That is, the suction refrigerant accommodated inside the piston 130 may increase in temperature and decrease in compression efficiency.

Thus, the linear compressor 10 is provided with a structure in which the bearing refrigerant flows through the bearing flow path X at a relatively low temperature. In particular, the flow path of the bearing refrigerant may be elongated through the inner side surface of the discharge cover 191 or the plenum guide surface 1928, which allows for a reduction in temperature.

The flow of bearing refrigerant supplied from the discharge unit 190 to the bearing flow path X will be described below through various embodiments. In particular, such a flow path structure is referred to as a bearing guide groove. In detail, the bearing guide groove corresponding to a flow path through which refrigerant flows from the upper space to the lower space.

In this case, the embodiments are divided into a first embodiment, a second embodiment, and a third embodiment. This is merely illustrative, and the present invention is not limited thereto. Also, the same reference numerals will be used for the same elements as those described above, and the description given above will be cited. Also, differences from the above-described configuration will be described in detail.

Figure 11:
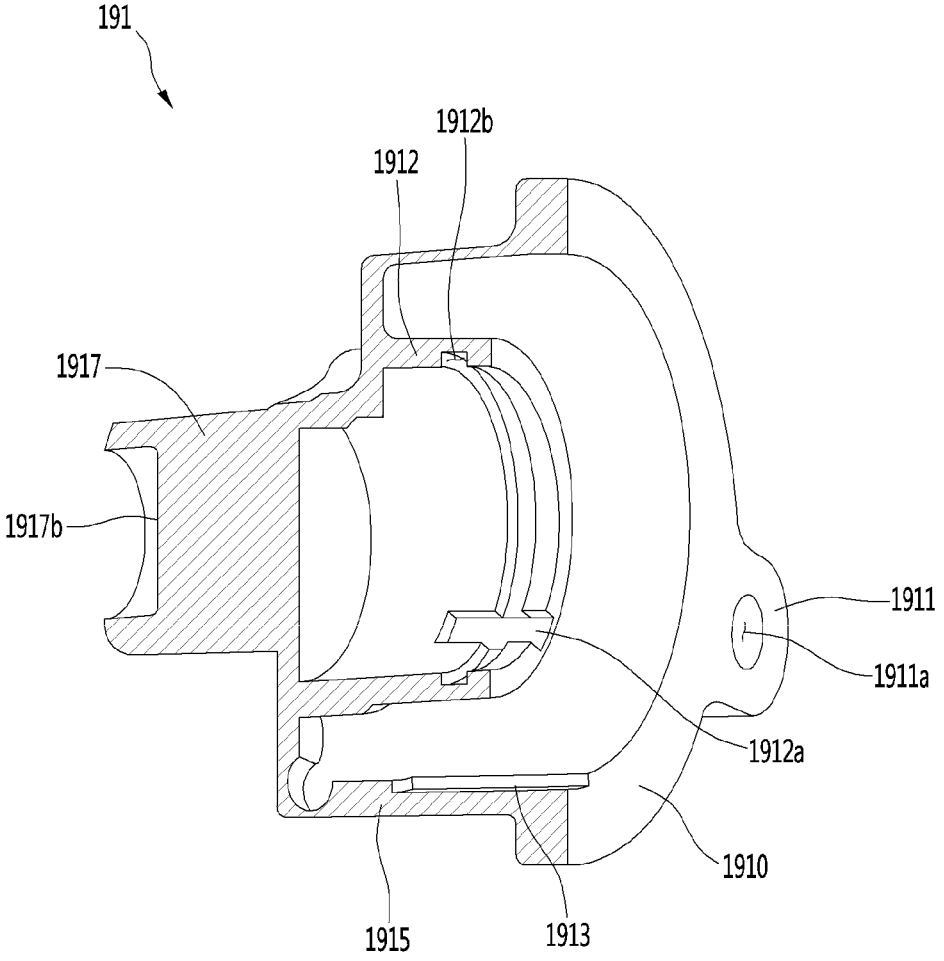
FIGS. 11 and 12 are views showing a bearing refrigerant flow path of a linear compressor according to a first embodiment of the present invention.
Figure 12:
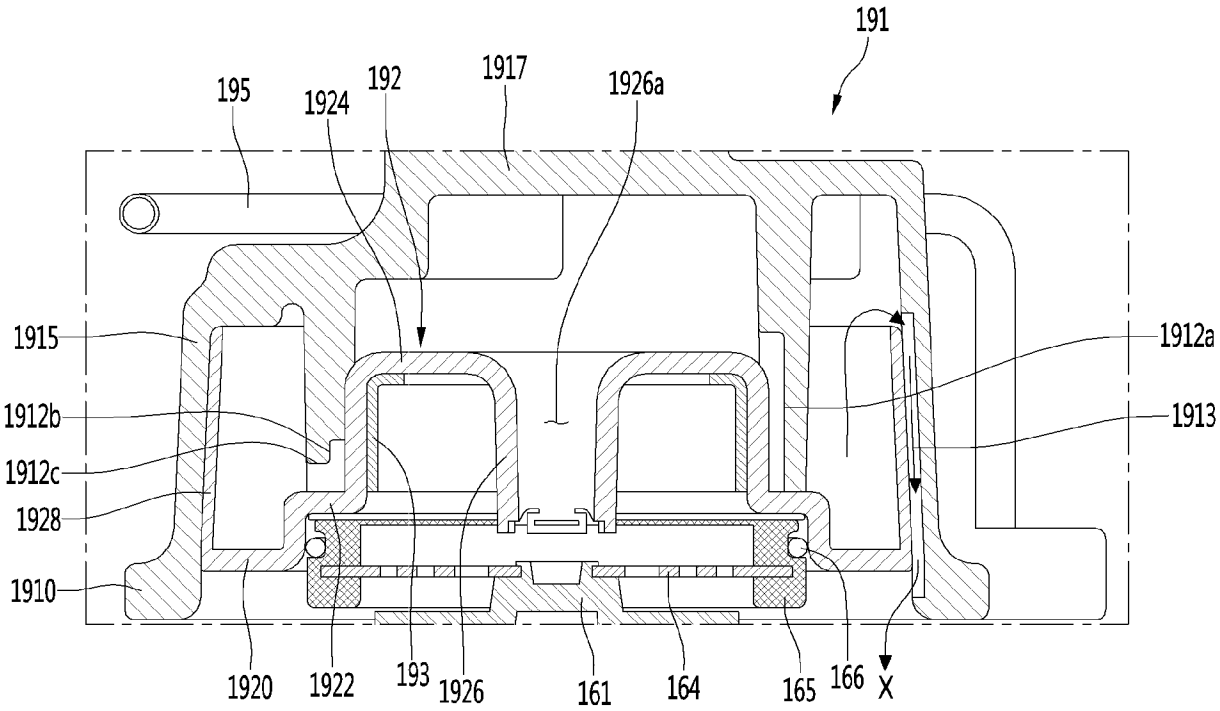

FIGS. 11 and 12 are views showing a bearing refrigerant flow path of a linear compressor according to a first embodiment of the present invention.

As shown in FIGS. 11 and 12, a bearing guide groove 1913 radially recessed outward is formed on the inner side surface of the discharge cover 191. Also, the bearing guide groove 1913 may extend axially.

In particular, the bearing guide groove 1913 further extends axially than the discharge plenum 192. In detail, the bearing guide groove 1913 has a greater axial length than the plenum guide surface 1928.

Also, the bearing guide groove 1913 extends from the axially front side of the plenum guide surface 1928 up to the axially rear side of the plenum guide surface 1928. That is, the axially front end of the bearing guide groove 1913 is formed at the axially front side of the plenum guide surface 1928, and the axial rear end of the bearing guide groove 1913 is formed at the axially rear side of the plenum guide surface 1928.

As described above, the plenum guide surface 1928 is installed in close contact with the inner side surface of the discharge cover 191. Thus, the plenum guide surface 1928 may prevent refrigerant from flowing into a gap between the inner side surface of the discharge cover 191 and the plenum guide surface 1928.

In this case, the bearing guide groove 1913 is recessed from the inner side surface of the discharge cover 191. Thus, the refrigerant may flow through a gap between the inner side surface of the discharge cover 191 and the plenum guide surface 1928 along the bearing guide groove 1913. That is, the bearing guide groove 1913 forms a flow path of the refrigerant passing through the plenum guide surface 1928 and the inner side surface of the discharge cover 191.

In other words, the bearing guide groove 1913 is formed to make the upper space and the lower space communicate with each other. In particular, the bearing guide groove 1913 extends to make the third discharge chamber D3 and the lower space communicate with each other.

The flow of refrigerant will be described based on such a configuration. The refrigerant discharged from the compression space P flows into the third discharge chamber D3 through the first and second discharge chambers D1 and D2. In this case, the refrigerant compressed in the compression space P may decrease in temperature while passing through each discharge chamber.

That is, the refrigerant having flown into the third discharge chamber D3 may have a lower temperature than the refrigerant having flown into the first and second discharge chambers D1 and D2. In this case, some of the refrigerant of the third discharge chamber D3 may flow into the bearing guide groove 1913.

Also, one end of the bearing guide groove 1913 communicating with the third discharge chamber D3 is placed at the axially upper side of the plenum guide surface 1928. Thus, some of the refrigerant having flown into the third discharge chamber D3 may flow axially upward along the plenum guide surface 1928 and may flow into the bearing guide groove 1913. Through such a process, the temperature of the refrigerant may further decrease.

In this case, the refrigerant having flown into the bearing guide groove 1913 corresponds to the bearing refrigerant. The bearing refrigerant flows axially backward along the bearing guide groove 1913. Thus, the bearing refrigerant flows to the upper portion of the discharge frame surface 1120. Also, the bearing refrigerant may be supplied to the bearing flow path X through the gas hole 1106.

In this case, the bearing guide groove 1913 and the gas hole 1106 may be circumferentially spaced apart from each other. Thus, the bearing refrigerant discharged from the bearing guide groove 1913 may flow circumferentially into the gas hole 1106. Through such a process, the temperature of the bearing refrigerant may further decrease.

Figure 13:
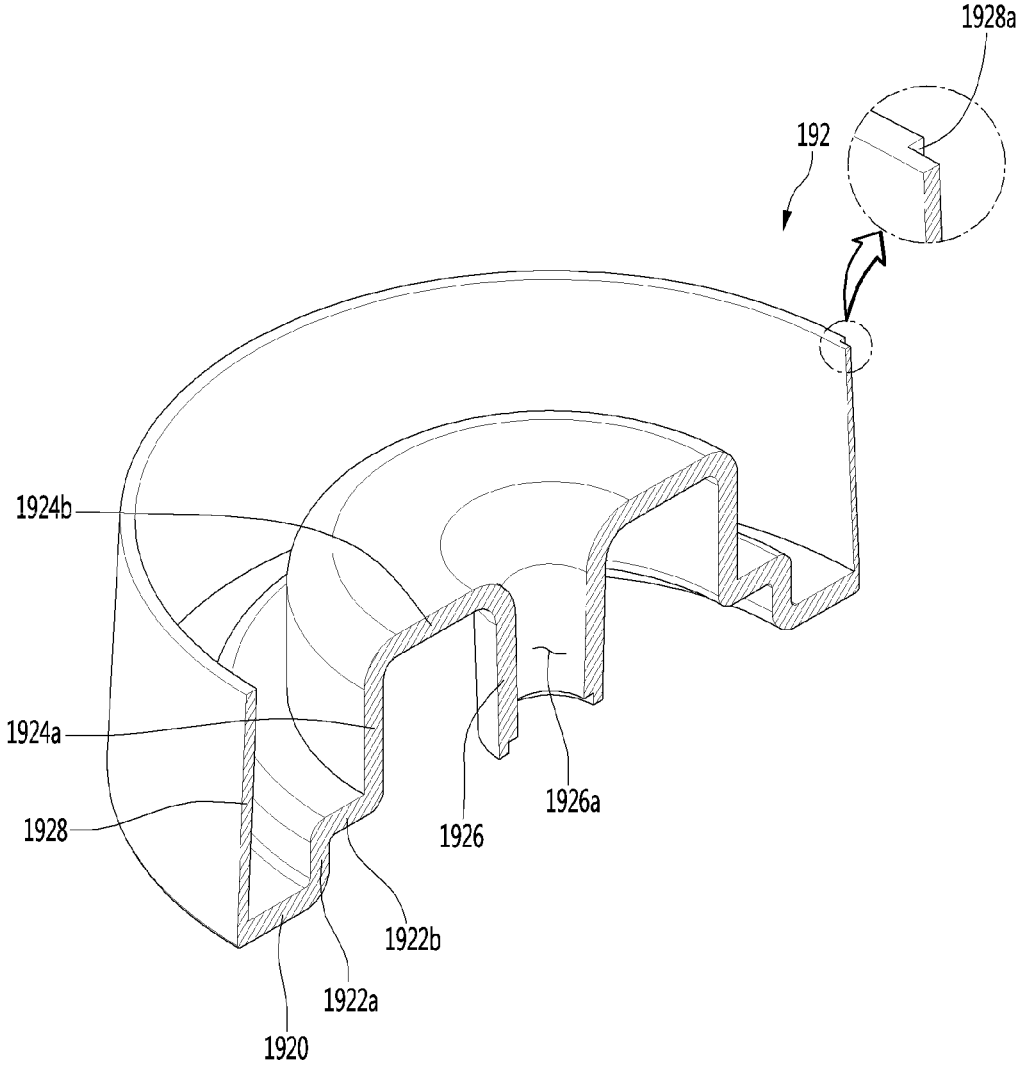
FIGS. 13 and 14 are views showing a bearing refrigerant flow path of a linear compressor according to a second embodiment of the present invention.
Figure 14:
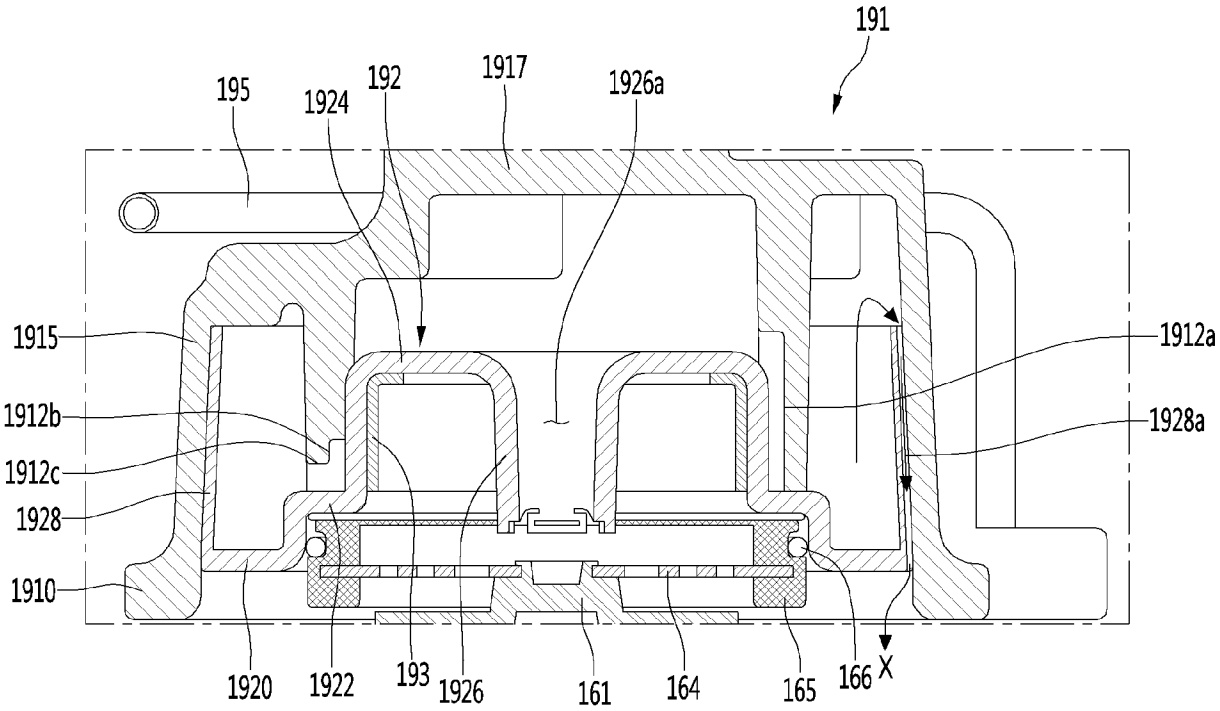

FIGS. 13 and 14 are views showing a bearing refrigerant flow path of a linear compressor according to a second embodiment of the present invention.

As shown in FIGS. 13 and 14, a bearing guide groove 1928*a* radially recessed inward is formed on the outer side surface of the plenum guide surface 1928. Also, the bearing guide groove 1928*a* may extend axially.

In particular, the bearing guide groove 1928*a* has the same axial length than the plenum guide surface 1928. That is, the bearing guide groove 1928*a* extends from the axially front end of the plenum guide surface 1928 up to the axially rear end.

As described above, the plenum guide surface 1928 is installed in close contact with the inner side surface of the discharge cover 191. Thus, the plenum guide surface 1928 may prevent refrigerant from flowing into a gap between the inner side surface of the discharge cover 191 and the plenum guide surface 1928.

In this case, the bearing guide groove 1928*a* is recessed from the outer side surface of the plenum guide surface 1928. Thus, the refrigerant may flow through a gap between the inner side surface of the discharge cover 191 and the plenum guide surface 1928 along the bearing guide groove 1928*a*. That is, the bearing guide groove 1928*a* forms a flow path of the refrigerant passing through the plenum guide surface 1928 and the inner side surface of the discharge cover 191.

In other words, the bearing guide groove 1928*a* is formed to make the upper space and the lower space to communicate with each other. In particular, the bearing guide groove 1928*a* extends to make the third discharge chamber D3 and the lower space communicate with each other.

The flow of refrigerant will be described based on such a configuration. The refrigerant discharged from the compression space P flows into the third discharge chamber D3 through the first and second discharge chambers D1 and D2. In this case, the refrigerant compressed in the compression space P may decrease in temperature while passing through each discharge chamber.

That is, the refrigerant having flown into the third discharge chamber D3 may have a lower temperature than the refrigerant having flown into the first and second discharge chambers D1 and D2. In this case, some of the refrigerant of the third discharge chamber D3 may flow into the bearing guide groove 1928*a*.

Also, one end of the bearing guide groove 1928*a* communicating with the third discharge chamber D3 is formed at the axially upper end of the plenum guide surface 1928. Thus, some of the refrigerant having flown into the third discharge chamber D3 may flow axially upward along the plenum guide surface 1928 and may flow into the bearing guide groove 1928*a*. Through such a process, the temperature of the refrigerant may further decrease.

In this case, the refrigerant having flown into the bearing guide groove 1928*a* corresponds to the bearing refrigerant. The bearing refrigerant flows axially backward along the bearing guide groove 1928*a*. Thus, the bearing refrigerant flows to the upper portion of the discharge frame surface 1120. Also, the bearing refrigerant may be supplied to the bearing flow path X through the gas hole 1106.

In this case, the bearing guide groove 1928*a* and the gas hole 1106 may be circumferentially spaced apart from each other. Thus, the bearing refrigerant discharged from the bearing guide groove 1928*a* may flow circumferentially into the gas hole 1106. Through such a process, the temperature of the bearing refrigerant may further decrease.

Figure 15:
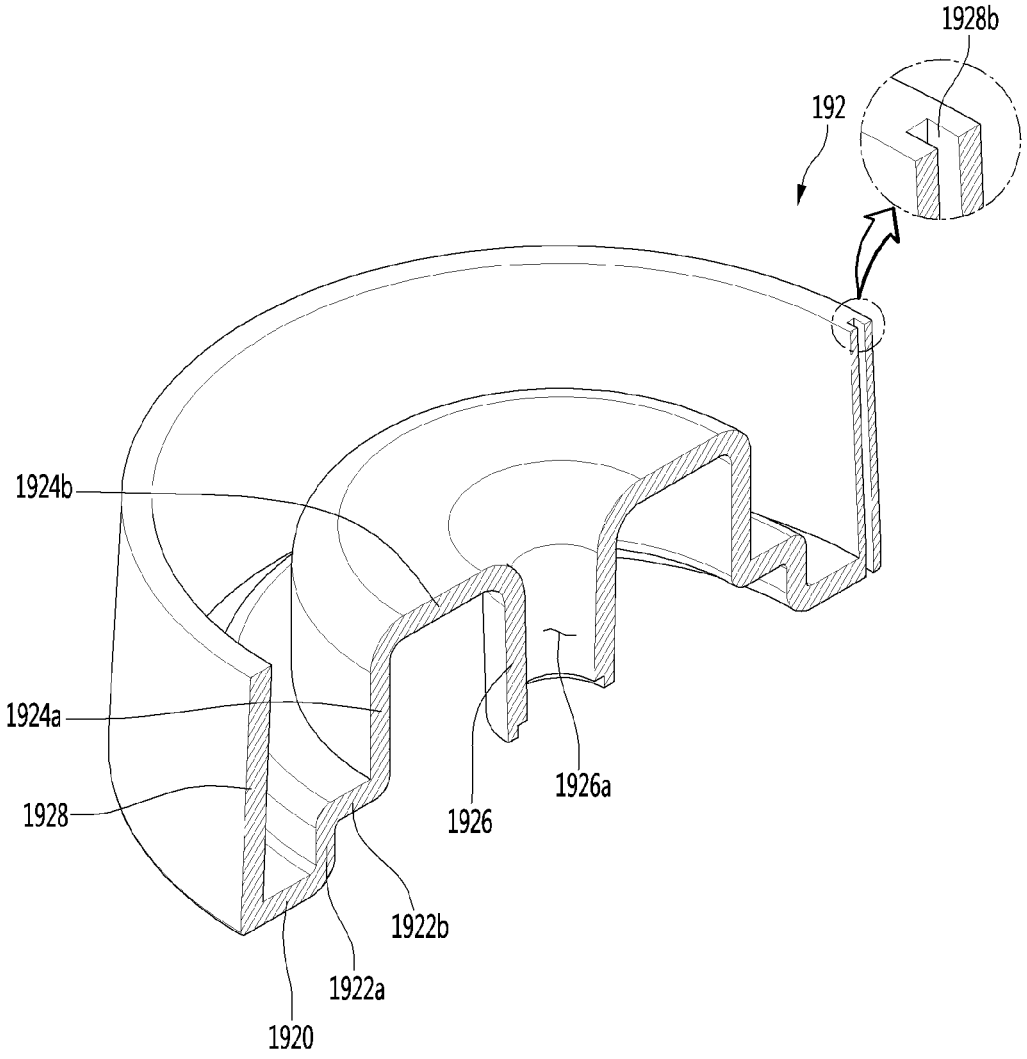
FIGS. 15 and 16 are views showing a bearing refrigerant flow path of a linear compressor according to a third embodiment of the present invention.
Figure 16:
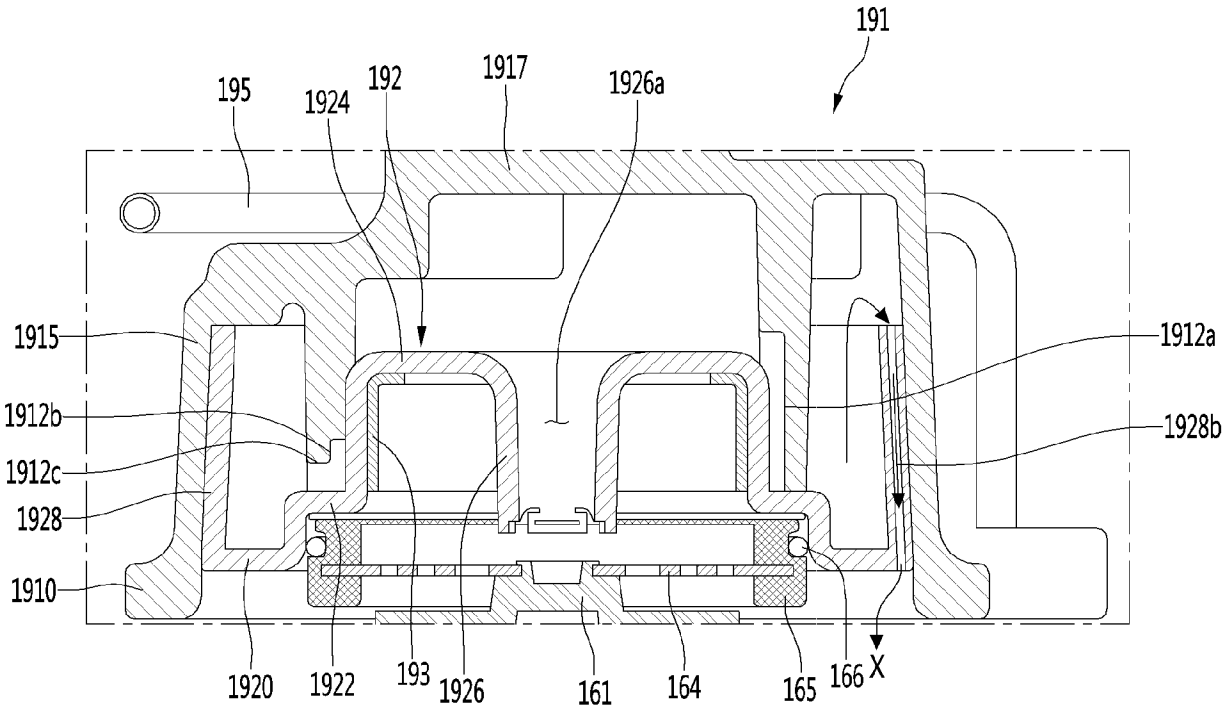

FIGS. 15 and 16 are views showing a bearing refrigerant flow path of a linear compressor according to a third embodiment of the present invention.

As shown in FIGS. 15 and 16, a bearing guide groove 1928*b* extending axially is formed on the plenum guide surface 1928. In detail, the bearing guide groove 1928*b* is formed between the inner side surface and the outer side surface of the plenum guide surface 1928.

Also, the bearing guide groove 1928*b* may be formed to axially pass through the plenum guide surface 1928. In particular, the bearing guide groove 1928*b* has the same axial length than the plenum guide surface 1928. That is, the bearing guide groove 1928*b* extends from the axially front end of the plenum guide surface 1928 up to the axially rear end.

As described above, the plenum guide surface 1928 is installed in close contact with the inner side surface of the discharge cover 191. Thus, the plenum guide surface 1928 may prevent refrigerant from flowing into a gap between the inner side surface of the discharge cover 191 and the plenum guide surface 1928.

In this case, the bearing guide groove 1928*b* is formed to pass through the plenum guide surface 1928. Thus, the refrigerant may flow through the plenum guide surface 1928 along the bearing guide groove 1928*b*. That is, the bearing guide groove 1928*b* forms a flow path of the refrigerant passing through the plenum guide surface 1928.

In particular, the bearing guide groove 1928*b* according to the third embodiment of the present invention forms a flow path inside the plenum guide surface 1928. This is different from the first and second embodiments in which a flow path is formed between the plenum guide surface 1928 and the discharge cover 191.

In other words, the bearing guide groove 1928*b* is formed to make the upper space and the lower space communicate with each other. In particular, the bearing guide groove 1928*b* extends to make the third discharge chamber D3 and the lower space communicate with each other.

The flow of refrigerant will be described based on such a configuration. The refrigerant discharged from the compression space P flows into the third discharge chamber D3 through the first and second discharge chambers D1 and D2. In this case, the refrigerant compressed in the compression space P may decrease in temperature while passing through each discharge chamber.

That is, the refrigerant having flown into the third discharge chamber D3 may have a lower temperature than the refrigerant having flown into the first and second discharge chambers D1 and D2. In this case, some of the refrigerant of the third discharge chamber D3 may flow into the bearing guide groove 1928*b*.

Also, one end of the bearing guide groove 1928*b* communicating with the third discharge chamber D3 is formed at the axially upper end of the plenum guide surface 1928. Thus, some of the refrigerant having flown into the third discharge chamber D3 may flow axially upward along the plenum guide surface 1928 and may flow into the bearing guide groove 1928*b*. Through such a process, the temperature of the refrigerant may further decrease.

In this case, the refrigerant having flown into the bearing guide groove 1928*b* corresponds to the bearing refrigerant. The bearing refrigerant flows axially backward along the bearing guide groove 1928*b*. Thus, the bearing refrigerant flows to the upper portion of the discharge frame surface 1120. Also, the bearing refrigerant may be supplied to the bearing flow path X through the gas hole 1106.

In this case, the bearing guide groove 1928*b* and the gas hole 1106 may be circumferentially spaced apart from each other. Thus, the bearing refrigerant discharged from the bearing guide groove 1928*b* may flow circumferentially into the gas hole 1106. Through such a process, the temperature of the bearing refrigerant may further decrease.

In summary, as the plenum guide surface 1928 is coupled to, and brought into close contact with, the discharge cover 191, the plenum guide surface 1928 may prevent heat of discharge refrigerant from being transferred. Also, a flow path through which the bearing refrigerant may flow is formed on the plenum guide surface 1928 or the discharge cover 191. The bearing refrigerant having flown through such a flow path may be transferred to the frame 110, the cylinder 120, and the piston 130 at a relatively low temperature.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be apparent to those skilled in the art that various modifications and variations can be made in the present invention without departing from the spirit or scope of the disclosures. Thus, it is intended that the present invention covers the modifications and variations of this disclosure provided they come within the scope of the appended claims and their equivalents.

What is claimed is:

1. A linear compressor comprising:

a cylinder that defines a compression space configured to receive refrigerant; and a discharge unit that defines a discharge space configured to receive the refrigerant discharged from the compression space, wherein the discharge unit comprises:

a discharge cover that defines an inner space therein, and a discharge plenum that is disposed in the inner space of the discharge cover, and wherein the discharge plenum comprises:

a plenum flange that extends radially and is in contact with an inner side surface of the discharge cover, a plenum seating part, a plenum body, and a plenum extension part that extend radially from an inner side end of the plenum flange, and a plenum guide surface that extends from an outer side end of the plenum flange toward the inner space of the discharge cover in a direction away from the cylinder and that is disposed in the inner space of the discharge cover, the plenum guide surface being in contact with the inner side surface of the discharge cover.

2. The linear compressor of claim 1, wherein the plenum flange extends radially such that the outer side end of the plenum flange is in contact with the inner side surface of the discharge cover, and wherein the plenum guide surface extends axially from the outer side end of the plenum flange in the direction away from the cylinder.

3. The linear compressor of claim 1, further comprising a discharge valve assembly that is configured to discharge, to the discharge space, the refrigerant that is compressed in the compression space, wherein the plenum seating part of the discharge plenum of the discharge unit extends radially inward from the plenum flange such that the discharge valve assembly is seated thereon.

4. The linear compressor of claim 3, wherein the discharge valve assembly comprises:

a discharge valve that is located at an axial side of the cylinder, the axial side facing the compression space;

a valve spring coupled to the discharge valve; and a spring support part located at a radial outer side of the valve spring and configured to support the valve spring, and wherein the plenum seating part comprises:

a first plenum seating part that extends axially from the plenum flange of the discharge plenum along a radial outer side surface of the spring support part of the discharge valve assembly; and a second plenum seating part that extends radially inward from the first plenum seating part along a surface of the spring support part of the discharge valve assembly.

5. The linear compressor of claim 1, wherein the discharge cover of the discharge unit comprises a partition sleeve that extends axially to partition the inner space of the discharge cover into an inner side and an outer side along a radial direction, wherein the plenum seating part of the discharge plenum of the discharge unit extends radially inward from the plenum flange to axially contact the partition sleeve of the discharge cover of the discharge unit, and wherein the plenum body of the discharge plenum of the discharge unit extends radially inward from the plenum seating part to radially contact the partition sleeve of the discharge cover of the discharge unit.

6. The linear compressor of claim 5, wherein the plenum body of the discharge plenum of the discharge unit comprises:

a first plenum body that extends axially from the plenum seating part along a radial inner side surface of the partition sleeve; and a second plenum body that extends radially inward from the first plenum body.

7. The linear compressor of claim 6, wherein the plenum extension part extends axially from an inner end in the radial direction of the second plenum body to thereby define a flow path configured to guide the refrigerant.

8. The linear compressor of claim 5, wherein the partition sleeve of the discharge cover of the discharge unit is radially spaced apart from the inner side surface of the discharge cover, and wherein the plenum guide surface is radially spaced apart from the partition sleeve of the discharge cover.

9. The linear compressor of claim 1, wherein the plenum flange divides the discharge space into a first discharge space and a second discharge space that are spaced apart from each other in an axial direction, and wherein the plenum seating part, the plenum body, the plenum extension part, and the plenum guide surface are disposed in the first discharge space.

10. The linear compressor of claim 9, wherein at least one of the plenum guide surface of the discharge plenum or the inner side surface of the discharge cover defines a bearing guide groove configured to guide the refrigerant from the first discharge space to the second discharge space.

11. The linear compressor of claim 10, wherein the bearing guide groove is radially recessed outward from the inner side surface of the discharge cover.

12. The linear compressor of claim 10, wherein the bearing guide groove is radially recessed inward from an outer side surface of the plenum guide surface of the discharge plenum of the discharge unit.

13. The linear compressor of claim 10, wherein the bearing guide groove is formed to pass through the plenum guide surface of the discharge plenum of the discharge unit.

14. The linear compressor of claim 9, wherein the first discharge space is divided into a plurality of discharge chambers comprising:

a first discharge chamber;

a second discharge chamber that is defined at a side of the first discharge chamber; and a third discharge chamber that is defined at a radial outer side of the first discharge chamber and the second discharge chamber.

15. The linear compressor of claim 14, wherein at least one of the plenum guide surface of the discharge plenum or the inner side surface of the discharge cover defines a bearing guide groove configured to guide the refrigerant from the third discharge chamber to the second discharge space.

16. The linear compressor of claim 1, wherein the plenum guide surface is an outer circumferential surface of the discharge plenum, and the inner side surface of the discharge cover is an inner circumferential surface of the discharge cover.

17. The linear compressor of claim 1, wherein an inner diameter of the discharge cover defined by the inner side surface of the discharge cover is equal to an outer diameter of the discharge plenum defined by the plenum guide surface.

18. A linear compressor comprising:

a cylinder that defines a compression space configured to receive refrigerant;

a frame disposed radially outside the cylinder; and a discharge unit that defines a discharge space configured to receive the refrigerant discharged from the compression space, wherein the discharge unit comprises:

a discharge cover that is coupled to the frame and defines an inner space therein, and a discharge plenum that is disposed in the inner space of the discharge cover and divides the discharge space into a plurality of discharge spaces, and wherein the discharge plenum comprises:

a plenum flange that extends radially and is in contact with an inner side surface of the discharge cover, and a plenum guide surface that extends from an outer side end of the plenum flange toward the inner space of the discharge cover in a direction away from the cylinder and that is disposed in the inner space of the discharge cover, the plenum guide surface being in contact with the inner side surface of the discharge cover.

19. The linear compressor of claim 18, wherein the discharge cover and the discharge plenum have a cylindrical shape, and wherein an inner diameter of the discharge cover defined by the inner side surface of the discharge cover is equal to an outer diameter of the discharge plenum defined by the plenum guide surface.

20. The linear compressor of claim 19, wherein the discharge cover comprises a partition sleeve that has a cylindrical shape extending axially to divide the inner space of the discharge cover into an inner side and an outer side in a radial direction, and wherein the plenum guide surface is disposed at the outer side of the partition sleeve.

* * * * *